US009291382B2

(12) United States Patent
Hardesty et al.

(10) Patent No.: US 9,291,382 B2
(45) Date of Patent: Mar. 22, 2016

(54) CONTROL SYSTEM FOR A DOOR OF AN ICE DISPENSER CHUTE

(71) Applicant: Sub-Zero, Inc., Madison, WI (US)

(72) Inventors: Terry D. Hardesty, Columbus, WI (US); Anderson Bortoletto, Waunakee, WI (US); Ryan Harings, Madison, WI (US)

(73) Assignee: Sub-Zero, Inc., Madison, WI (US)

( * ) Notice: Subject to any disclaimer, the term of this patent is extended or adjusted under 35 U.S.C. 154(b) by 550 days.

(21) Appl. No.: 13/744,568

(22) Filed: Jan. 18, 2013

(65) Prior Publication Data

US 2014/0202196 A1 Jul. 24, 2014

(51) Int. Cl.
*F25C 5/00* (2006.01)
*F25C 5/18* (2006.01)

(52) U.S. Cl.
CPC ..... *F25C 5/182* (2013.01); *F25C 5/002* (2013.01)

(58) Field of Classification Search
CPC ..... F25C 2600/02; F25C 5/005
See application file for complete search history.

(56) References Cited

U.S. PATENT DOCUMENTS

| | | | | |
|---|---|---|---|---|
| 2,420,240 | A | 5/1947 | Haggerty | |
| 5,269,154 | A | 12/1993 | Schmidt | |
| 5,442,933 | A | 8/1995 | Unger | |
| 5,474,213 | A * | 12/1995 | Unger | 222/108 |
| 6,880,355 | B2 | 4/2005 | Jung | |
| 6,889,517 | B1 | 5/2005 | Dehli | |
| 7,392,665 | B2 | 7/2008 | Lee et al. | |
| 7,617,698 | B2 | 11/2009 | Bowen et al. | |
| 7,703,297 | B2 | 4/2010 | Bowen et al. | |
| 7,900,465 | B2 | 3/2011 | Wetekamp et al. | |
| 8,069,887 | B2 | 12/2011 | Dirnberger et al. | |
| 8,083,106 | B2 | 12/2011 | Park et al. | |
| 8,376,184 | B2 | 2/2013 | Buchstab et al. | |
| 2007/0256442 | A1 | 11/2007 | Lyvers et al. | |
| 2010/0200621 | A1* | 8/2010 | Buchstab et al. | 222/638 |
| 2011/0067430 | A1 | 3/2011 | Martin et al. | |
| 2012/0017512 | A1 | 1/2012 | Lee et al. | |
| 2013/0334261 | A1* | 12/2013 | Berger et al. | 222/504 |

* cited by examiner

*Primary Examiner* — Cassey D Bauer
(74) *Attorney, Agent, or Firm* — Bell & Manning, LLC

(57) ABSTRACT

An ice dispensing system is provided that includes a motor, a processor, and a computer-readable medium. The motor is mounted to an ice chute door. The computer-readable medium is operably coupled to the processor and comprises computer-readable instructions configured to control opening of the ice chute door by energizing the motor at a first voltage for a first time period after receipt of an ice dispense request; after energizing the motor at the first voltage for the first time period, control energizing of the motor at a second voltage at least as long as the ice dispense request is received to maintain the ice chute door in the open position; and after energizing the motor at the second voltage, control de-energizing of the motor to allow the ice chute door to return to a closed position. The second voltage is less than the first voltage.

20 Claims, 20 Drawing Sheets

CONTROL SYSTEM FOR A DOOR OF AN ICE DISPENSER CHUTE

BACKGROUND

Currently, refrigerators and freezers are designed to comply with energy consumption targets that are enforced by regulatory agencies for both domestic and international markets. These energy consumption targets are consistently updated to ever more stringent values leading appliance manufactures to constantly improve their design through proper component selection, system optimization, and use of efficient controls. Ice dispensers are typically included in a freezer door, a refrigerator door, or a refrigerator compartment to conveniently provide ice to a consumer without opening of the freezer door. The chute that connects directly or indirectly to an ice receptacle in the freezer compartment has an opening through which the ice is dispensed to a consumer. A chute door typically covers the chute opening and should be designed to maintain as much of the cold air within and to prevent warm (relatively), moist air from entering the freezer or refrigerator compartment as possible while having the capability of dispensing ice through the chute on demand with minimum energy expenditure.

SUMMARY

In an example embodiment, a computer-readable medium is provided having stored thereon computer-readable instructions that when executed by a processor, cause the processor to control opening of an ice chute door by energizing a motor at a first voltage for a first time period after receipt of an ice dispense request; after energizing the motor at the first voltage for the first time period, control energizing of the motor at a second voltage at least as long as the ice dispense request is received to maintain the ice chute door in the open position; and after energizing the motor at the second voltage, control de-energizing of the motor to allow the ice chute door to return to a closed position. The second voltage is less than the first voltage.

In another example embodiment, an ice dispensing system is provided. The ice dispensing system includes, but is not limited to, a door casing, an ice chute door mounted to the door casing, a motor, a processor, and a computer-readable medium. The motor is mounted to the ice chute door to move the ice chute door to an open position relative to the door casing when energized. The computer-readable medium has stored thereon computer-readable instructions that when executed by the processor, cause the processor to control opening of the ice chute door by energizing the motor at a first voltage for a first time period after receipt of an ice dispense request; after energizing the motor at the first voltage for the first time period, control energizing of the motor at a second voltage at least as long as the ice dispense request is received to maintain the ice chute door in the open position; and after energizing the motor at the second voltage, control de-energizing of the motor to allow the ice chute door to return to a closed position. The second voltage is less than the first voltage.

In yet another example embodiment, a refrigerator is provided. The refrigerator includes, but is not limited to, a plurality of walls defining a freezer compartment, a door, a hinge pivotally mounting the door to a wall of the plurality of walls, an ice chute door casing mounted to one of the plurality of walls or the door, an ice chute door mounted to the ice chute door casing, a motor, a processor, and a computer-readable medium. The motor is mounted to the ice chute door to move the ice chute door to an open position relative to the door casing when energized. The computer-readable medium has stored thereon computer-readable instructions that when executed by the processor, cause the processor to control opening of the ice chute door by energizing the motor at a first voltage for a first time period after receipt of an ice dispense request; after energizing the motor at the first voltage for the first time period, control energizing of the motor at a second voltage at least as long as the ice dispense request is received to maintain the ice chute door in the open position; and after energizing the motor at the second voltage, control de-energizing of the motor to allow the ice chute door to return to a closed position. The second voltage is less than the first voltage.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
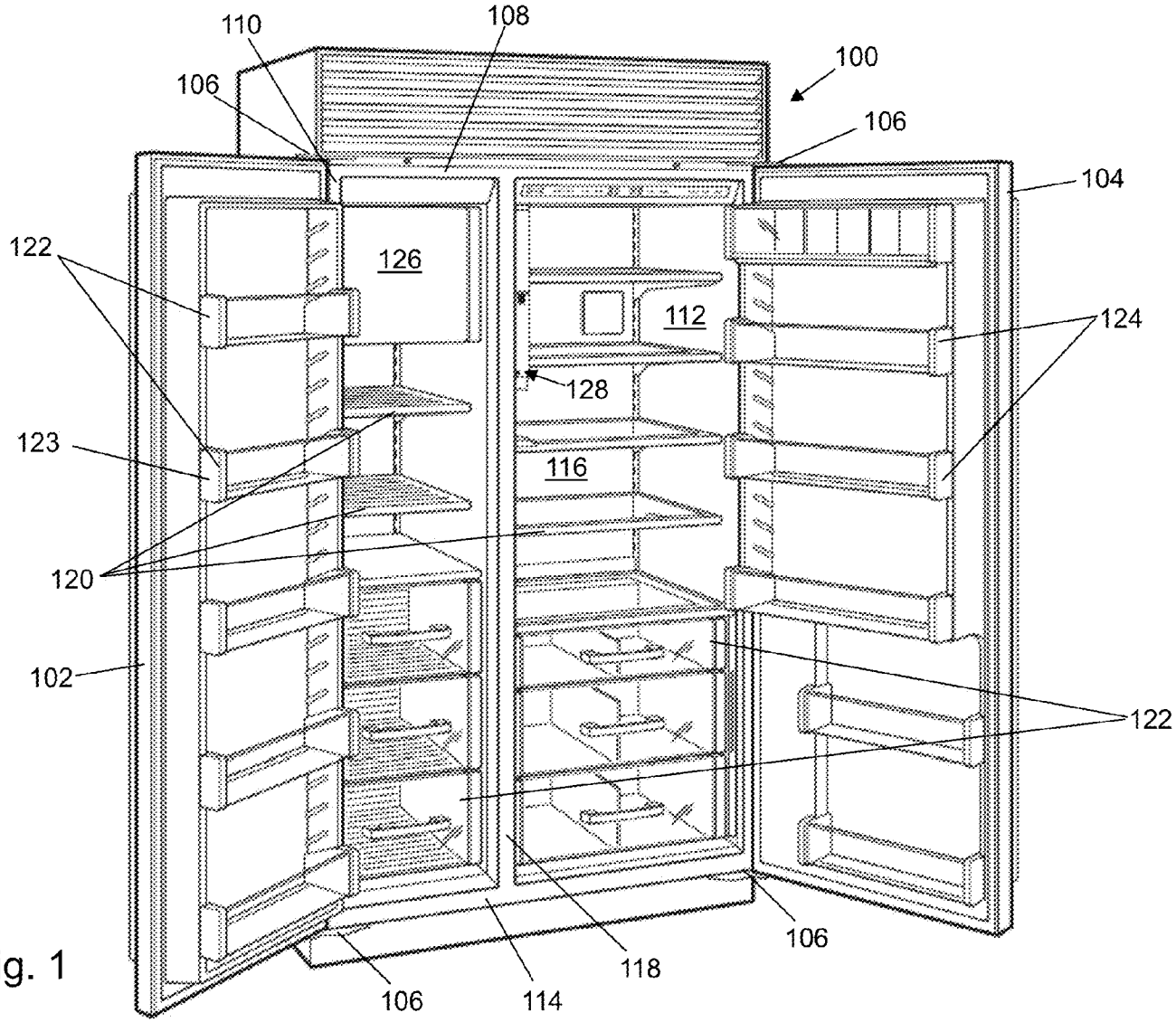
FIG. 1 depicts a left side, perspective view of a refrigerator with open compartment doors in accordance with an illustrative embodiment.

With reference to FIG. 1, a refrigerator 100 is shown in accordance with an illustrative embodiment. Refrigerator 100 may include a freezer compartment door 102, a refrigerator compartment door 104, a plurality of hinges 106, a top wall 108, a first side wall 110, a second side wall 112, a bottom wall 114, a back wall 116, and a divider wall 118. In the illustrative embodiment, freezer compartment door 102 is rotably mounted to top wall 108 and bottom wall 114 using two hinges of the plurality of hinges 106, and refrigerator compartment door 104 is rotably mounted to top wall 108 and bottom wall 114 using another two hinges of the plurality of hinges 106. In alternative embodiments, freezer compartment door 102 and/or refrigerator compartment door 104 may be rotably mounted to different walls of refrigerator 100 using a fewer or a greater number of hinges. Freezer compartment door 102 provides access to a freezer compartment defined by top wall 108, first side wall 110, bottom wall 114, back wall 116, divider wall 118, and freezer compartment door 102 when freezer compartment door 102 is in a closed position. Refrigerator compartment door 104 provides access to a refrigerated compartment defined by top wall 108, second side wall 112, bottom wall 114, back wall 116, divider wall 118, and refrigerator compartment door 104 when refrigerator compartment door 104 is in a closed position.

Use of directional terms, such as top, bottom, right, left, front, back, etc. are merely intended to facilitate reference to the various surfaces of the described structures relative to the orientations shown in the drawings and are not intended to be limiting in any manner. In the illustrative embodiment of FIG. 1, the freezer compartment is mounted to the left of the refrigerated compartment in a side-by-side type configuration though other relative mounting locations may be used without limitation.

Divider wall separates the freezer compartment from the refrigerator compartment. In the illustrative embodiment, divider wall 118 extends vertically between top wall 108 and bottom wall 114. Of course, in alternative embodiments, divider wall 118 may extend horizontally to separate the two compartments with the freezer compartment either above or below the refrigerated compartment. Additionally, in alternative embodiments, the locations of the freezer compartment and the refrigerated compartment may be reversed. Further, refrigerator 100 may include more than two compartments. Additionally, refrigerator 100 may not include a refrigerated compartment. In general, a temperature of one or more refrigerated compartments is maintained at an adequate temperature for fresh foods by appropriate cooling components as understood by a person of skill in the art, and a temperature of one or more freezer compartments is maintained at an adequate temperature for frozen foods by appropriate cooling components as understood by a person of skill in the art.

Though shown in the illustrative embodiment as forming a generally rectangular shaped enclosure, refrigerator 100 may form any shaped enclosure including other polygons as well as circular or elliptical enclosures. As a result, freezer compartment door 102, refrigerator compartment door 104, and the walls forming refrigerator 100 may have any shape including other polygons as well as circular or elliptical shapes.

One or more shelves 120, drawers 122, or other receptacles 124 may be mounted within the freezer compartment and the refrigerator compartment. An ice maker/dispenser 126 may be mounted within the freezer space to make and store ice. In an alternative embodiment, ice maker/dispenser 126 may be mounted to the inside surface of freezer compartment door 102 as understood by a person of skill in the art. For example, ice maker/dispenser 126 may be positioned on a door shelf 123 of the receptacles 124 to dispense ice when freezer compartment door 102 is either in the opened or the closed positions. Ice maker/dispenser 126 further may be mounted directly to a wall of refrigerator 100. As understood by a person of skill in the art, the dispensing of ice by the ice dispenser may be controlled using a switch activated by a consumer. For illustration, the switch may be similar to that described in U.S. Pat. No. 7,814,762 titled INTEGRATED ICE DISPENSER SWITCH and issued Oct. 19, 2010.

As understood by a person of skill in the art, the walls that form refrigerator 100 include insulation to assist in maintenance of the desired temperature in the freezer and refrigerator compartments. Electrical wiring and various conduits may further be located in the walls. The one or more shelves 120, drawers 122, or other receptacles 124 may be formed of one or more materials, such as metals, glass, and/or plastics having a sufficient strength and rigidity to support food items or other items stored in refrigerator 100.

As used in this disclosure, the term "mount" includes join, unite, connect, couple, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

Figure 2:
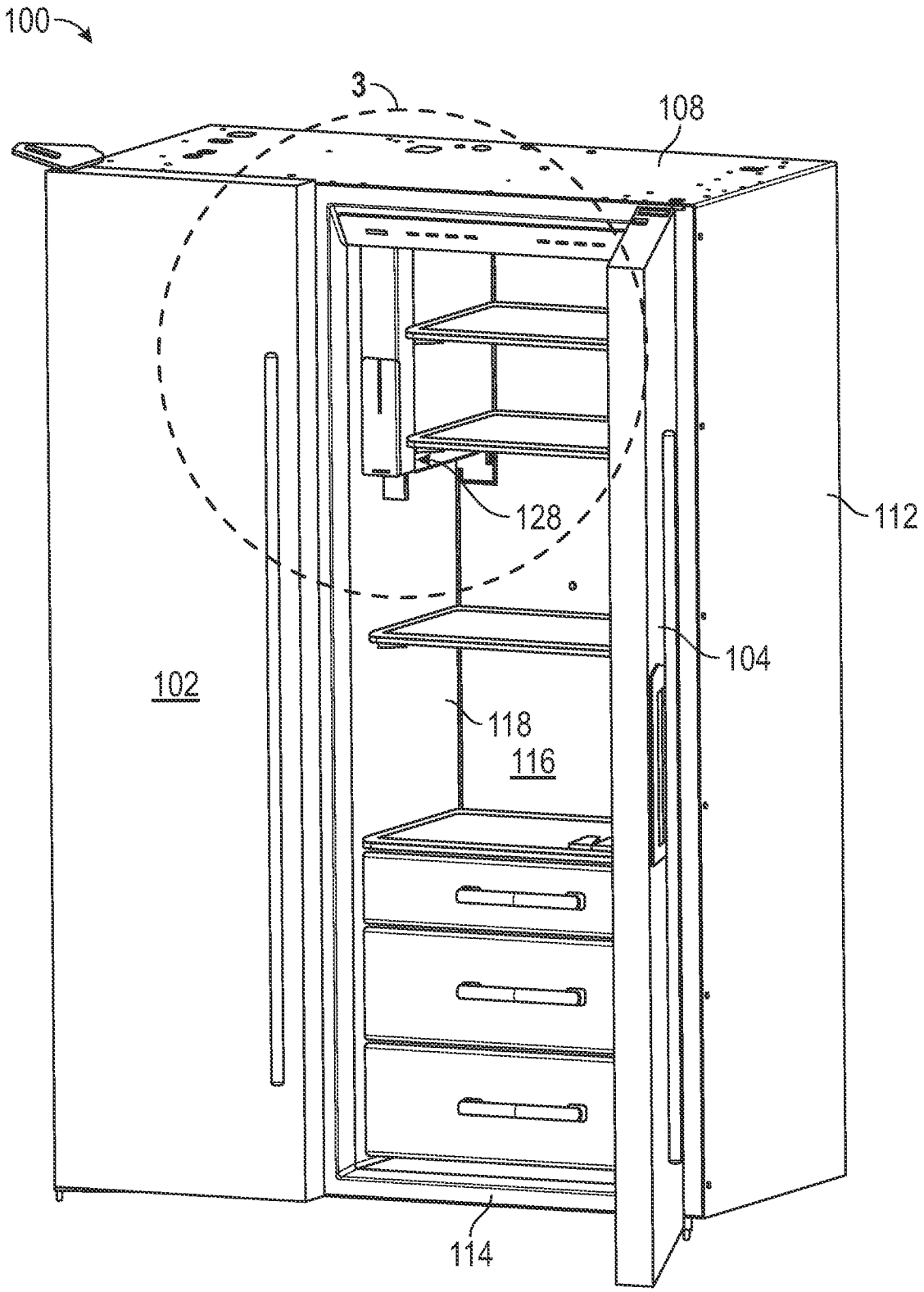
FIG. 2 depicts a right side, perspective view of a refrigerator with an open refrigerator compartment door in accordance with an illustrative embodiment.

In the illustrative embodiment of FIGS. 1 and 2, an ice dispensing housing 128 of ice maker/dispenser 126 is positioned on divider wall 118 in the refrigerator compartment and is configured to dispense ice when requested by a consumer from ice made and stored by ice maker/dispenser 126. The components of ice maker/dispenser 126 described herein may be formed of one or more materials, such as metals and/or plastics, having a sufficient strength and rigidity to support the described application.

Figure 3:
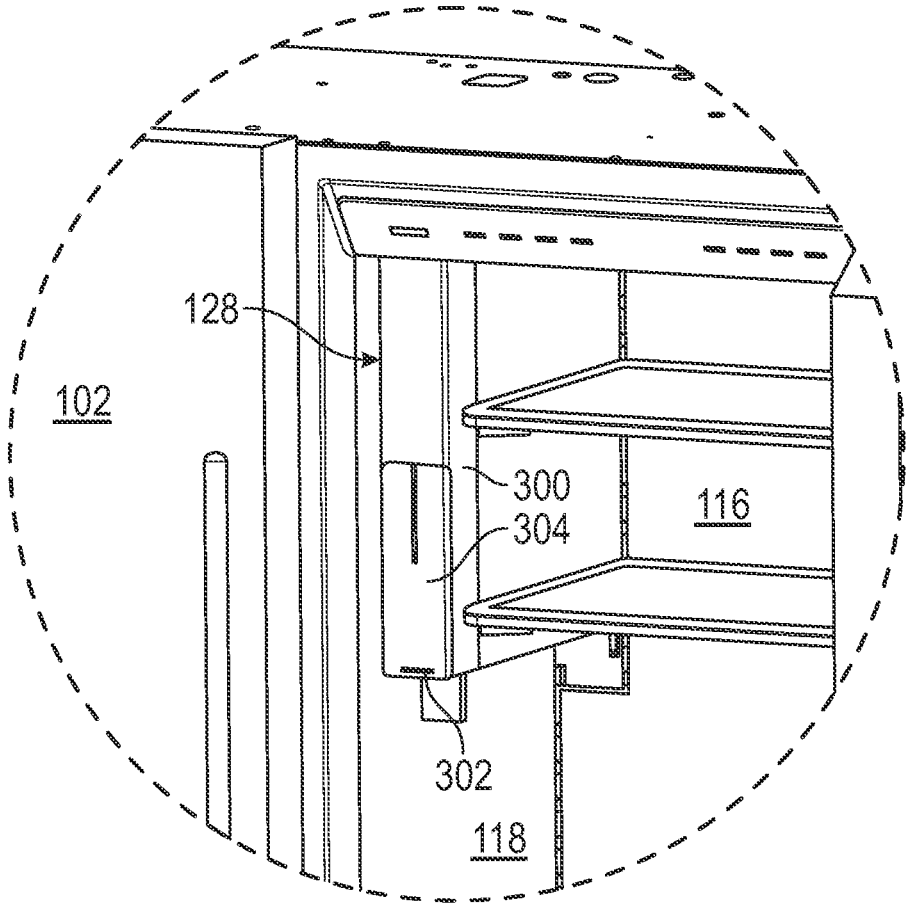
FIG. 3 depicts a zoomed view of the ice dispenser of the refrigerator of FIG. 2 in accordance with an illustrative embodiment.

With reference to FIG. 3, ice dispensing housing 128 includes an ice drop housing 300, an ice dispensing mouth 302, and an ice dispensing lever 304. Movement of ice dispensing lever 304 triggers an ice dispense request sensor 1312 (shown with reference to FIG. 13) configured to detect movement of ice dispensing lever 304 and to send a signal to a processor 1310 (shown with reference to FIG. 13). A variety of ice dispense request sensors are known to a person of skill in the art. For example, a variety of pressure, optical, or electromagnetic sensors may be used to detect a request by a user to dispense ice into a container. After detection of an ice dispense request, ice is dispensed through ice dispensing mouth 302. Thus, in the illustrative embodiment of FIGS. 1-3, ice is dispensed by opening of refrigerator compartment door 104 and activation of ice dispensing lever 304.

Figure 4:
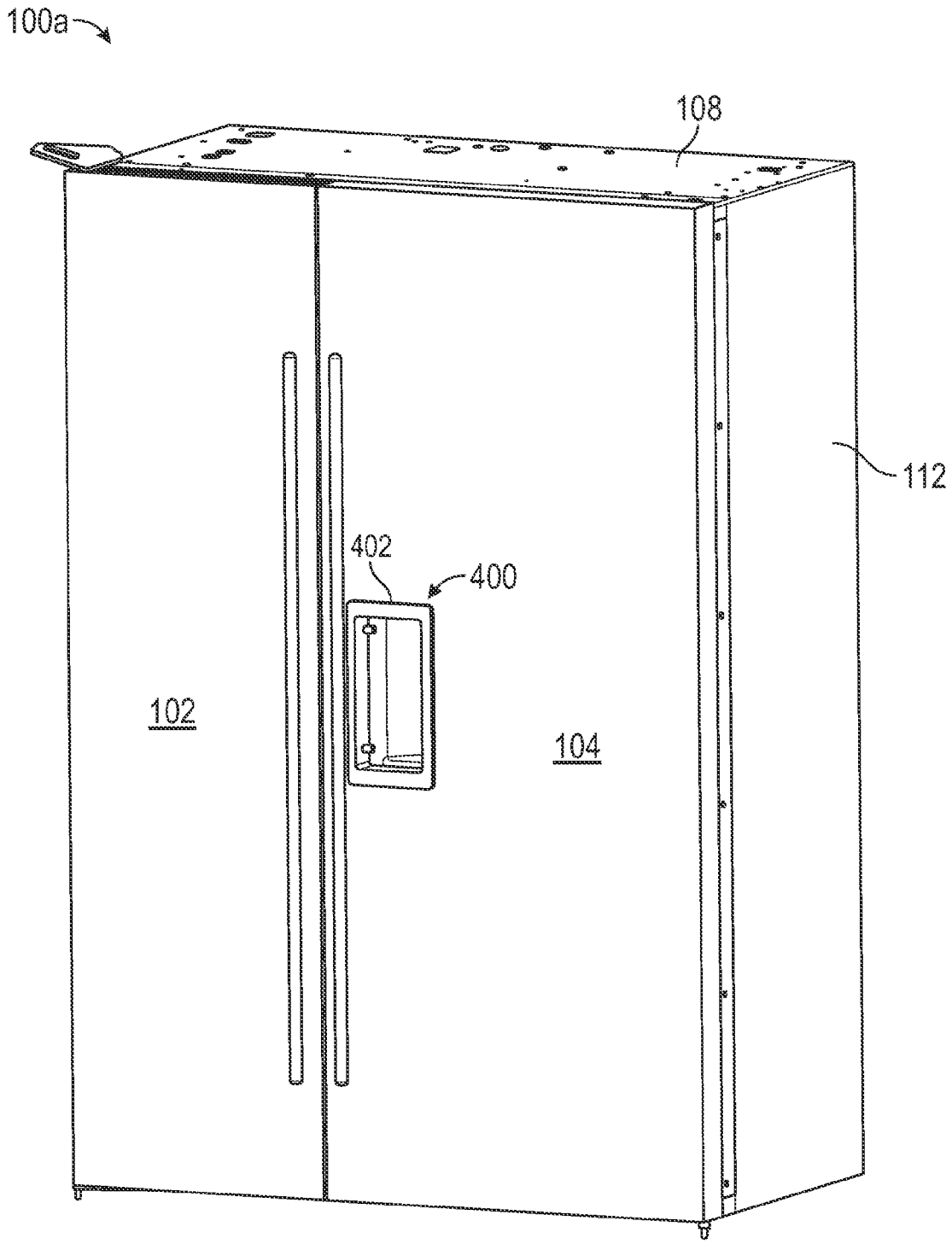
FIG. 4 depicts a right side, perspective view of a refrigerator including an ice dispenser on a refrigerator compartment door with closed compartment doors in accordance with an illustrative embodiment.
Figure 5:
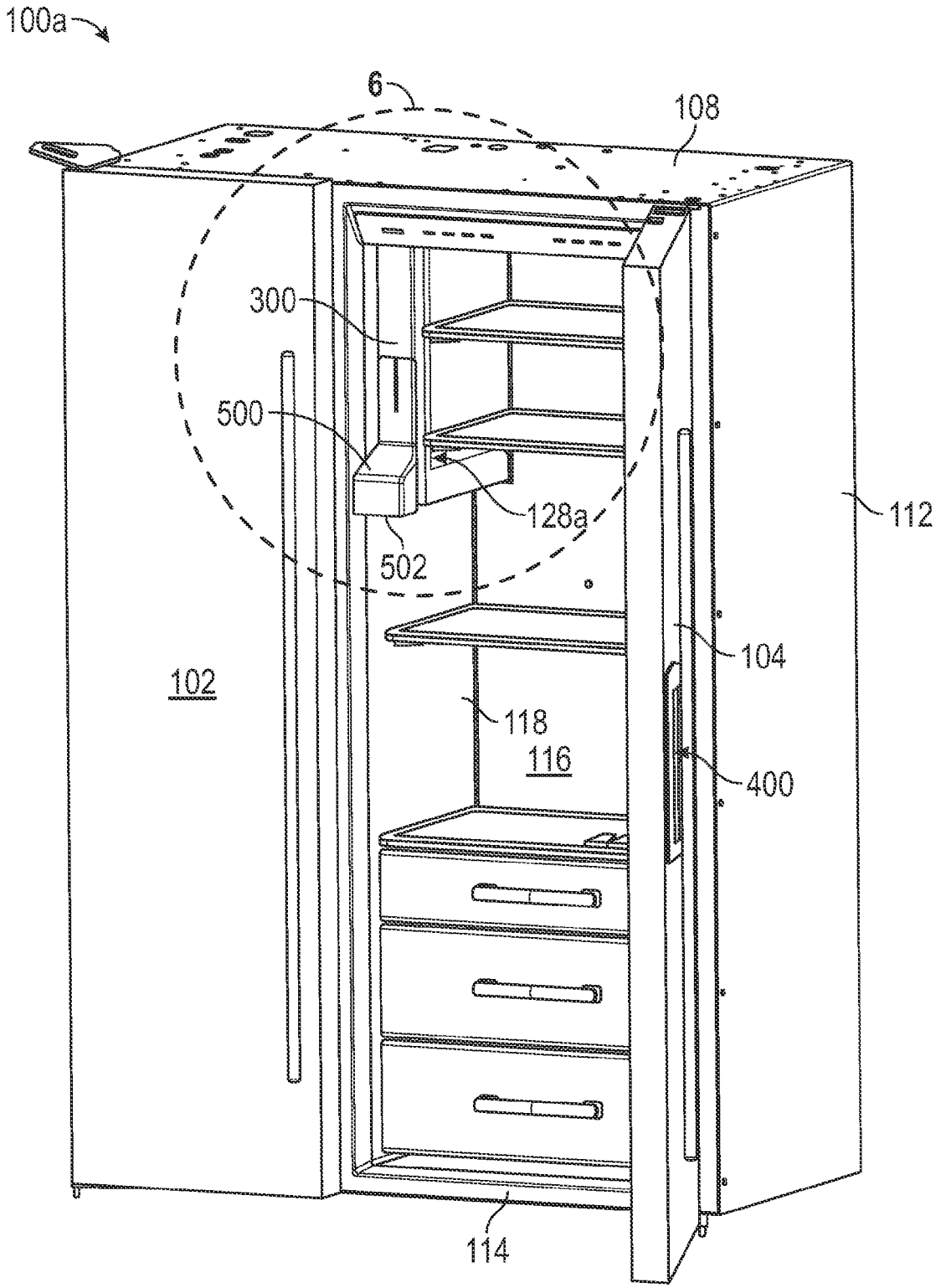
FIG. 5 depicts a right side, perspective view of the refrigerator of FIG. 4 with an open refrigerator compartment door in accordance with an illustrative embodiment.
Figure 6:
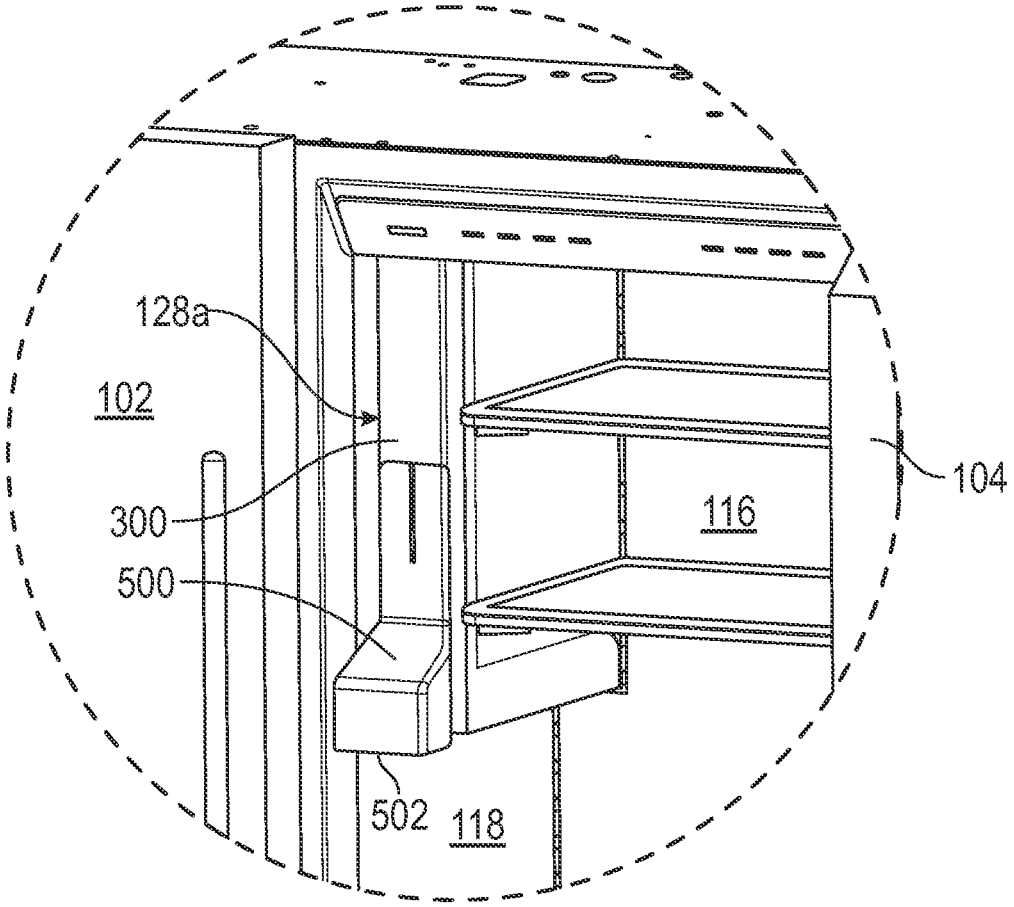
FIG. 6 depicts a zoomed view of the ice dispenser of the refrigerator of FIG. 5 in accordance with an illustrative embodiment.

With reference to FIG. 4, a right side, perspective view of a second refrigerator 100*a* including an ice dispenser 400 mounted on refrigerator compartment door 104 with refrigerator compartment door 104 in a closed position is shown in accordance with an illustrative embodiment. With reference to FIG. 5, a right side, perspective view of second refrigerator 100*a* with refrigerator compartment door 104 in an open position is shown in accordance with an illustrative embodiment. With reference to FIG. 6, a zoomed view of second refrigerator 100*a* with refrigerator compartment door 104 in an open position is shown in accordance with an illustrative embodiment. In the illustrative embodiment of FIG. 4, an ice dispensing cavity 400 of ice maker/dispenser 126 is positioned on refrigerator compartment door 104 and is configured to dispense ice when requested by a consumer from ice made and stored by ice maker/dispenser 126. As understood by a person of skill in the art, a container may be placed in ice dispensing cavity 400. Placement of the container in ice dispensing cavity 400 may be detected by ice dispense request sensor 1312, which triggers dispensing of ice through a hole in a top wall 404 of ice dispensing cavity 400. As another illustrative embodiment, a switch may be activated by a consumer, for example using their hand or a container, and may be detected by ice dispense request sensor 1312, which triggers dispensing of ice through a hole in a top wall 404 of ice dispensing cavity 400.

In the illustrative embodiment of FIGS. 5 and 6, a second ice dispensing housing 128*a* of ice maker/dispenser 126 is positioned on divider wall 118 in the refrigerator compartment and is configured to dispense ice through top wall 404 of ice dispensing cavity 400 when requested by a consumer from ice made and stored by ice maker/dispenser 126. Second ice dispensing housing 128*a* includes ice drop housing 300, an ice redirection housing 500, and a second ice dispensing mouth 502. After detection of the ice dispense request, ice is dispensed through second ice dispensing mouth 502 after being redirected towards refrigerator compartment door and ice dispensing cavity 400 by ice redirection housing 500. Ice dispensed through second ice dispensing mouth 502 is dispensed through the hole in top wall 404 of ice dispensing cavity 400. Thus, in the illustrative embodiment of FIGS. 4-6, ice is dispensed from ice maker/dispenser 126 positioned in the freezer compartment through divider wall 118 and refrigerator compartment door 104 when refrigerator compartment door 104 is closed. Though not shown, ice dispensing cavity 400 can be mounted in freezer compartment door 102 instead of refrigerator compartment door 104 with an appropriately located ice dispensing mouth as understood by a person of skill in the art. Of course, a water dispenser may be located adjacent the ice dispensing mouth wherever located.

Figure 7:
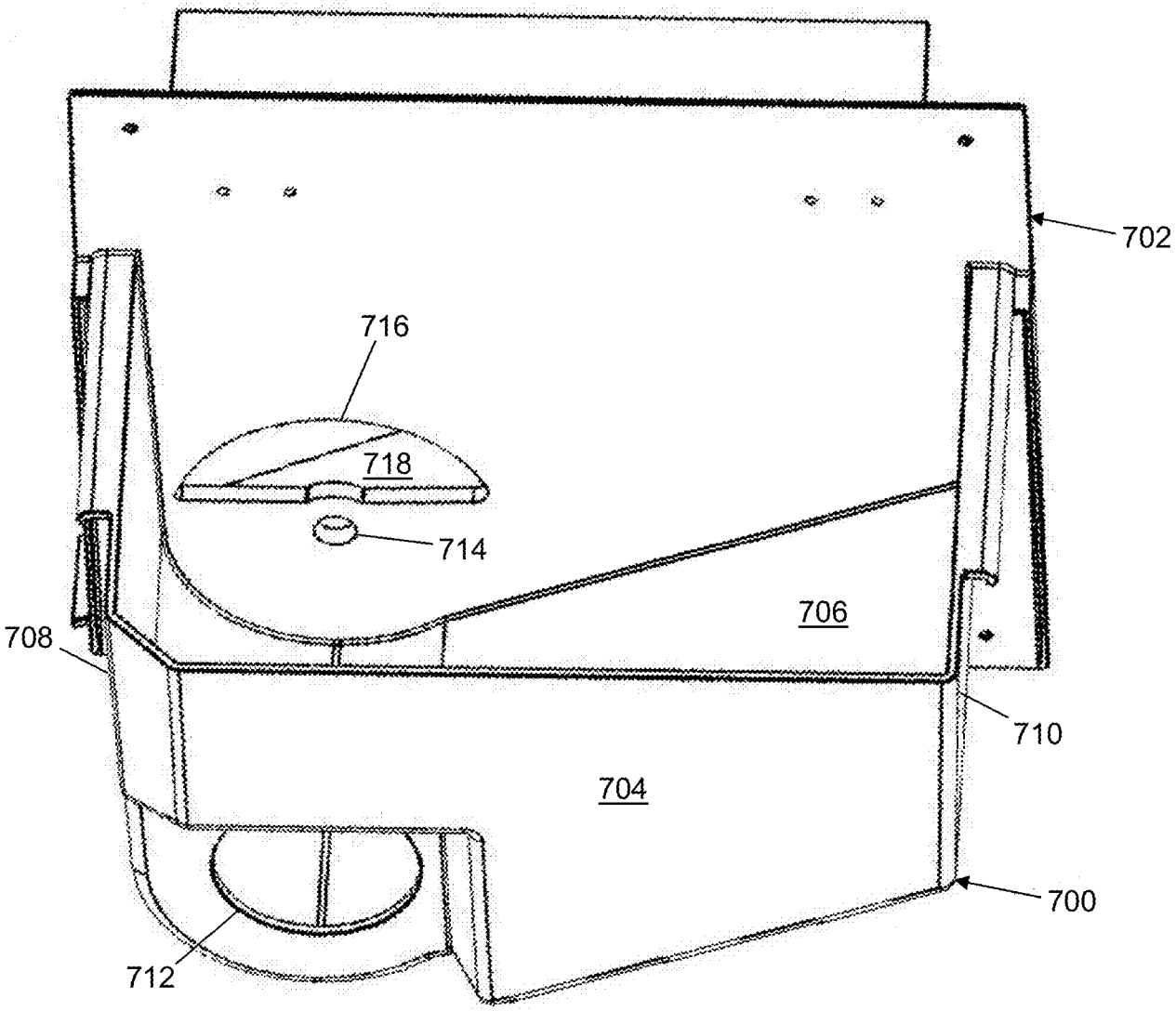
FIG. 7 depicts a top, back perspective view of an ice receptacle in accordance with an illustrative embodiment.
Figure 8:
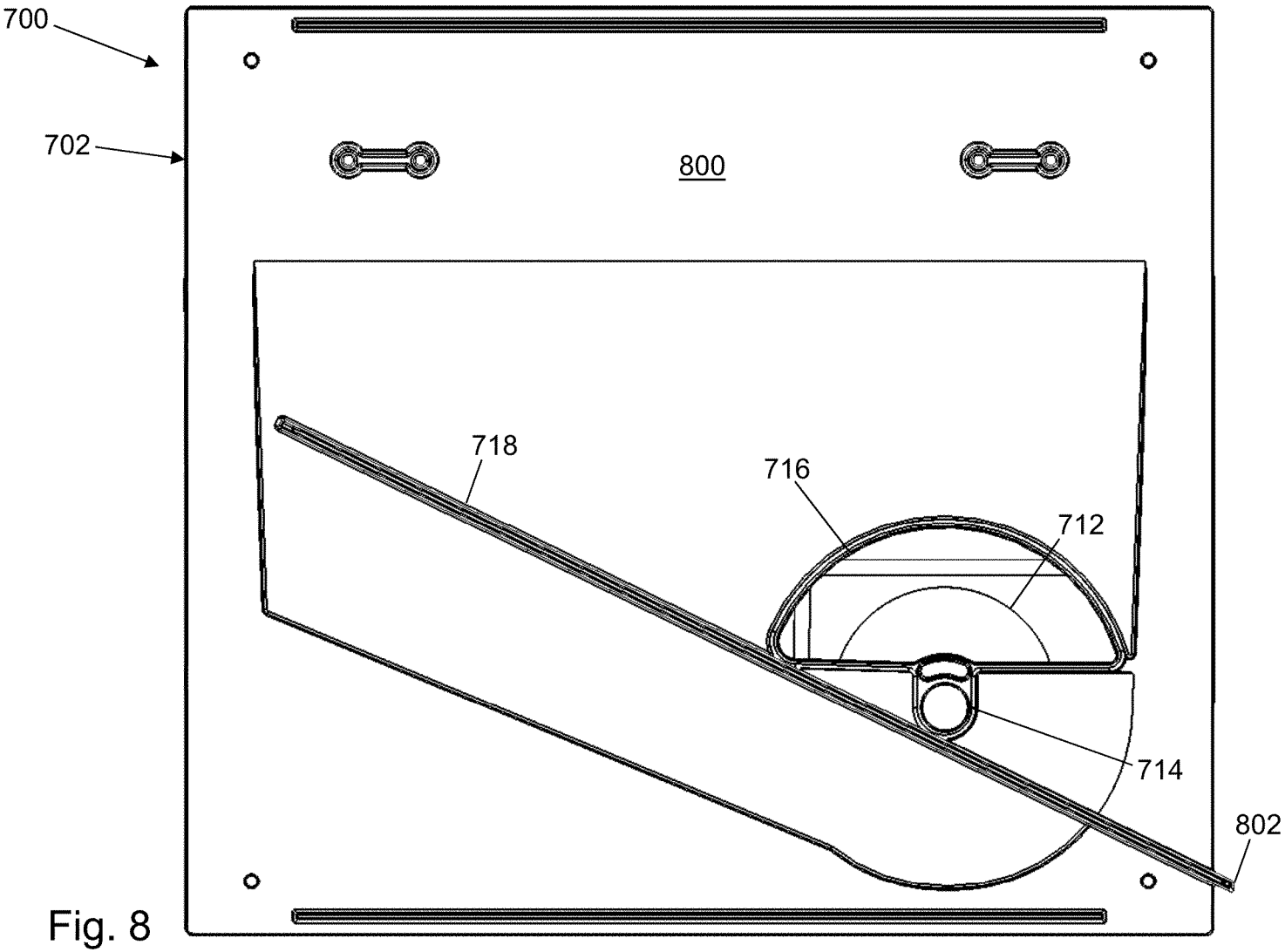
FIG. 8 depicts a front view of the ice receptacle of FIG. 7 in accordance with an illustrative embodiment.

With reference to FIG. 7, a top, back perspective view of an ice receptacle 700 of ice maker/dispenser 126 is shown in accordance with an illustrative embodiment. With reference to FIG. 8, a front view of ice receptacle 700 is shown in accordance with an illustrative embodiment. Ice from an ice maker (not shown) of ice maker/dispenser 126 is discharged into ice receptacle 700. The ice maker may have a variety of forms as understood by a person of skill in the art. Ice pieces, or cubes, may be formed by the ice maker and delivered to ice receptacle 700 as understood by a person of skill in the art. The term ice cube is not intended to be indicative of the shape of the ice piece as the ice piece may be formed to have a variety of shapes including spheres, cylinders, multi-sided polygons, etc. all of which may be referenced generally as an ice cube. The size of the ice cube is further not intended to be limiting.

In the illustrative embodiment of FIGS. 7 and 8, ice receptacle 700 includes a front wall 702, a back wall 704, a bottom wall 706, a right side wall 708, and a left side wall 710, which form a generally rectangular collection area for the ice cubes though ice receptacle 700 may have other polygonal and spherical shapes in alternative embodiments. Top edges of front wall 702, back wall 704, left side wall 710, and right side wall 708 form an ice receiving aperture. In the illustrative embodiment, the ice maker (not shown) is positioned above the ice receiving aperture to discharge ice into ice receptacle 700. In alternative embodiments, the ice maker need not be positioned above the ice receiving aperture. For example, the ice maker may be positioned adjacent a side wall of ice receptacle 700. Ice receptacle 700 may be slideably mounted within the freezer compartment on rails mounted to one or more of the walls of refrigerator 100 such that ice receptacle 700 is removable from refrigerator 100.

Though not shown, ice maker/dispenser 126 further may include an auger having a shaft that includes one or more flights. The one or more flights may be spiral or helical in shape and define at least one complete 360 degree flight. The auger may be mounted to an auger cap mounted in an auger cap aperture 712 formed in back wall 704 though other mounting methods may be used in alternative embodiments. The shaft of the auger may further extend through a shaft aperture 714 in front wall 702 of ice receptacle 700. The shaft of the auger may be rotated by an auger actuator 1316 (shown with reference to FIG. 13) mounted to rotate the auger cap. Rotation of the one or more flights conveys ice stored in ice receptacle 700 on demand through an ice dispensing aperture 716 in front wall 702 of ice receptacle 700. In the illustrative embodiment, bottom wall 706 is sloped downwards toward the auger.

After being pushed through ice dispensing aperture 716, the ice drops onto a chute 718 mounted on a front surface 800 of front wall 702. Chute 718 is mounted to extend from front wall 702 exterior to ice receptacle 700. In the illustrative embodiment, chute 718 slopes downward toward a lower right corner of front wall 702 to allow gravity to assist in the delivery of the ice cubes towards a dispensing end 802 of chute 718. Of course, chute 718 may slope downwards toward a lower left corner of front wall 702 in an alternative embodiment. From chute 718, the ice cubes may be dispensed through an ice chute door.

Figure 9:
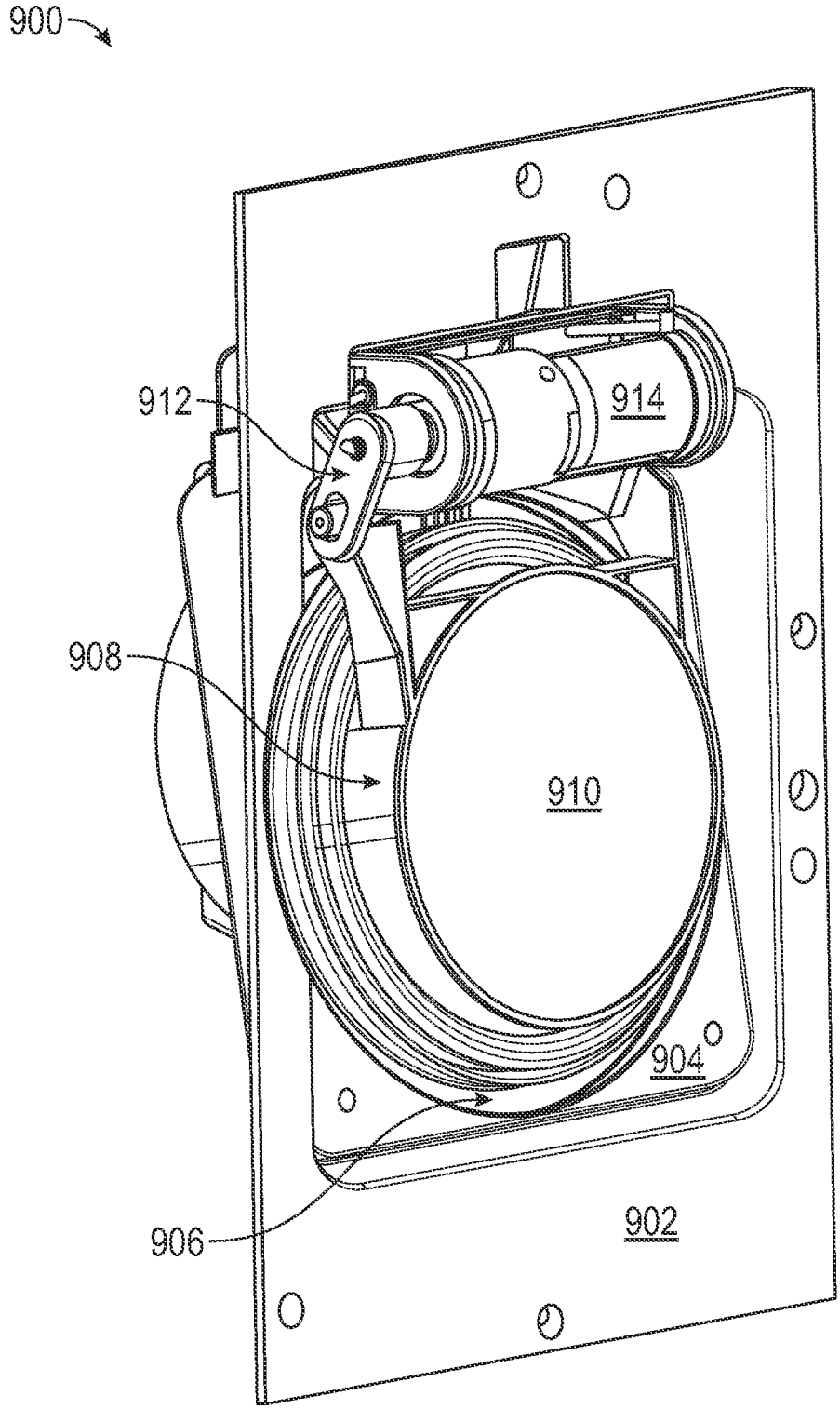
FIG. 9 depicts a left, front perspective view of an ice chute door mechanism with a closed ice chute door in accordance with an illustrative embodiment.
Figure 10:
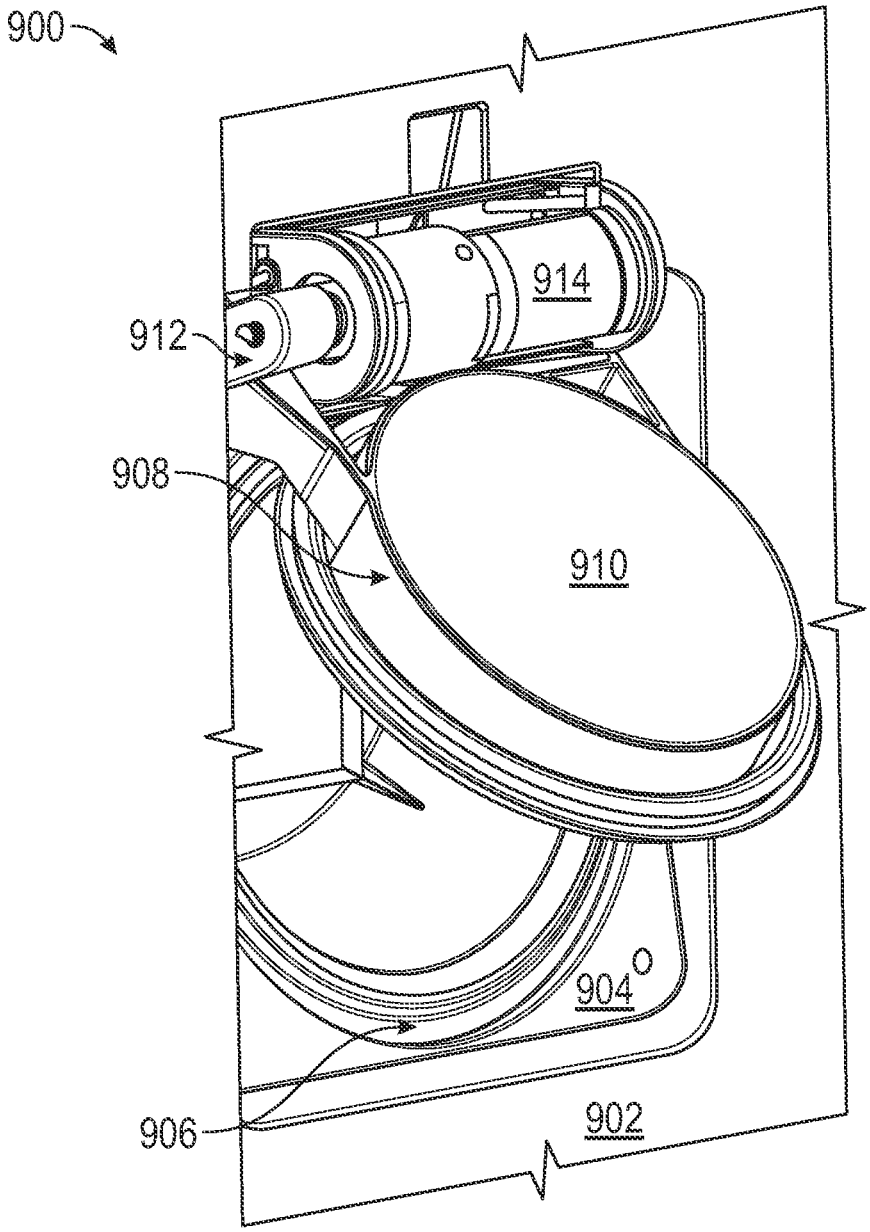
FIG. 10 depicts a left, front perspective view of the ice chute door mechanism of FIG. 9 with an open ice chute door in accordance with an illustrative embodiment.

With reference to FIG. 9, an ice chute door mechanism 900 is shown in accordance with an illustrative embodiment. In the illustrative embodiment, ice chute door mechanism 900 includes a mounting plate 902, a gasket 904, a door casing 906, an ice chute door 908, a door insulator 910, a link arm 912, and a motor 914. With reference to FIG. 9, ice chute door mechanism 900 is shown with ice chute door 908 in a closed position. With reference to FIG. 10, ice chute door mechanism 900 is shown with ice chute door 908 in an open position.

Figure 11A:
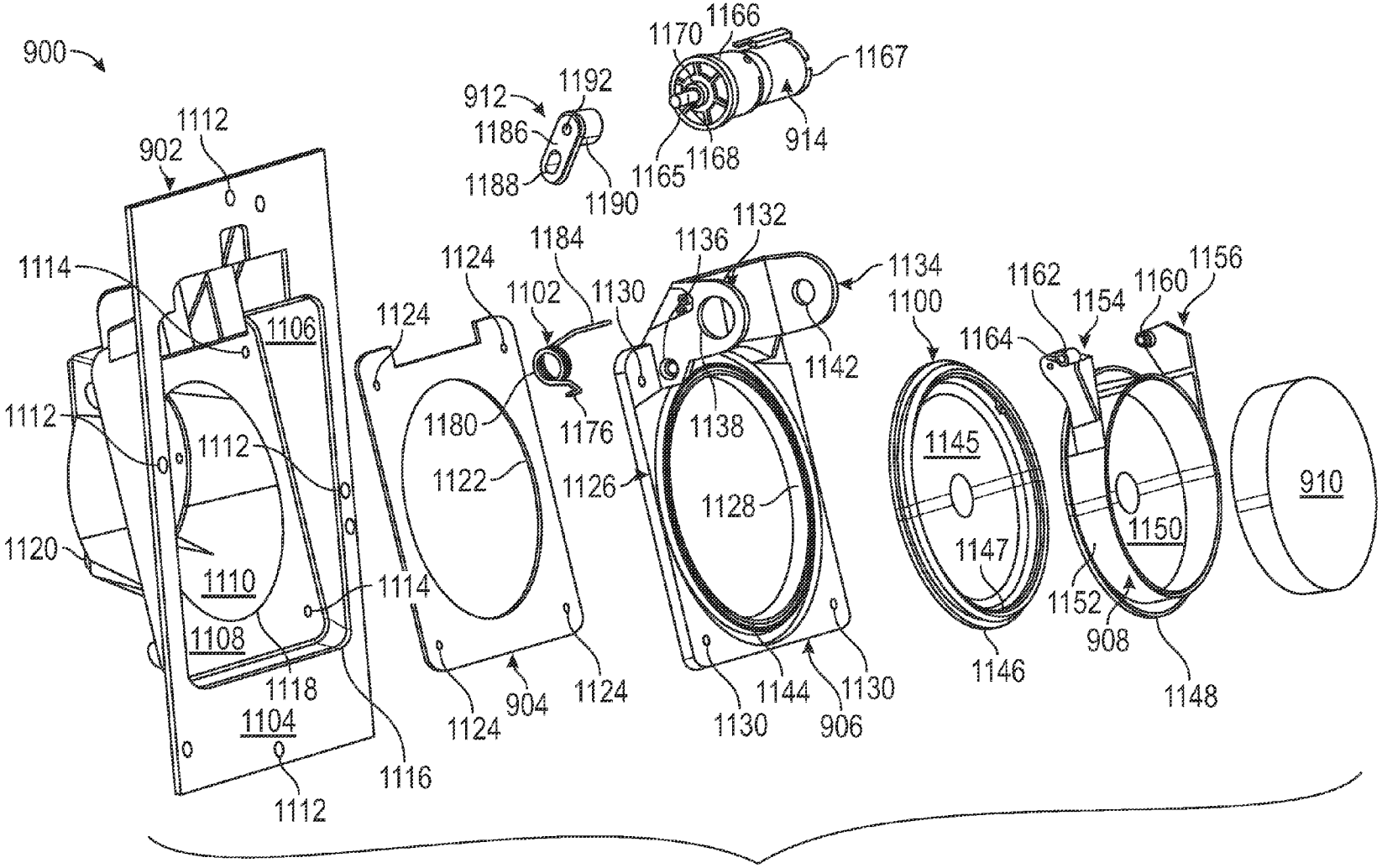
FIG. 11*a* depicts an exploded left, front perspective view of the ice chute door mechanism of FIG. 9 in accordance with an illustrative embodiment.
Figure 11B:
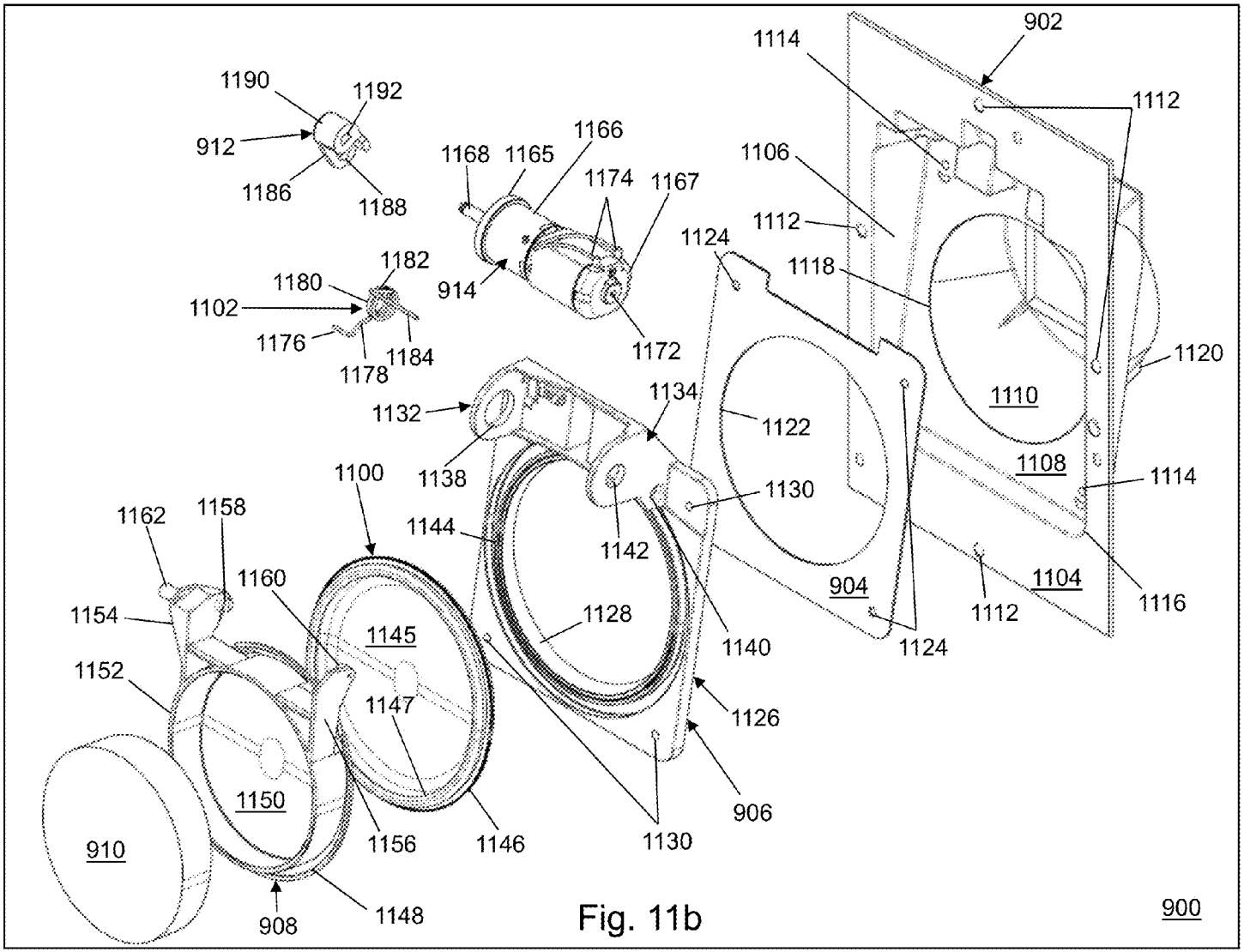
FIG. 11*b* depicts an exploded right, front perspective view of the ice chute door mechanism of FIG. 9 in accordance with an illustrative embodiment.

With reference to FIG. 11*a*, an exploded left, front perspective view of ice chute door mechanism 900 is shown in accordance with an illustrative embodiment. With reference to FIG. 11*b*, an exploded right, front perspective view of ice chute door mechanism 900 is shown in accordance with an illustrative embodiment. In the illustrative embodiment, ice chute door mechanism 900 further includes a door gasket and a biasing mechanism 1102.

With reference to FIGS. 11*a* and 11*b*, mounting plate 902 includes a mounting face 1104, a cavity wall 1106, a door mounting face 1108, a chute wall 1110, a first plurality of mounting apertures 1112, and a second plurality of mounting apertures 1114. Mounting plate 902 may be formed of a single piece of material, for example, by molding, or may be formed of multiple distinct pieces mounted together. Mounting face 1104 may be mounted to a surface of divider wall 118. Of course, mounting face 1104 may be mounted to other walls or a door of refrigerator 100. For example, one or more fasteners may be inserted in the first plurality of mounting apertures 1112 to mount mounting face 1104 to a wall or door of refrigerator 100.

Cavity wall 1106 extends generally perpendicularly from a first cut-out 1116 formed in mounting face 1104. Cavity wall 1106 is sized and shaped to accommodate gasket 904, door casing 906 and motor 914 and movement of link arm 912 and biasing mechanism 1102. Door mounting face 1108 extends generally perpendicularly from cavity wall 1106. Door mounting face 1108 is sized and shaped similar to gasket 904 and includes the second plurality of mounting apertures 1114.

Chute wall 1110 extends generally perpendicularly from a second cut-out 1118 formed in door mounting face 1108. Chute wall 1110 is sized and shaped to accommodate a plurality of ice cubes from chute 718 of ice receptacle 700. Chute wall 1110 also is sized and shaped to maximize a wall insulation in that area. Dispensing end 802 of chute 718 is positioned adjacent to a bottom edge surface 1120 of chute wall 1110 so that ice flows from chute 718 to the bottom surface of chute wall 1110 to flow out of ice chute door 908 when ice chute door 908 is in the open position.

Gasket 904 has a generally flat shape and mounts to and provides an air seal between mounting plate 902 and door casing 906. Gasket 904 includes a third cut-out 1122 and a third plurality of apertures 1124 formed there through. Third cut-out 1122 is sized and shaped similar to second cut-out 1118 and generally aligns with second cut-out 1118 when gasket 904 is mounted to mounting plate 902. Gasket 904 may be mounted to door mounting face 1108 or a back face of door casing 906 using adhesive and/or one or more fasteners that may be inserted in the third plurality of apertures 1124 and the second plurality of mounting apertures 1112 or the third plurality of mounting apertures 1130 or both set of mounting apertures 1112, 1130.

Door casing 906 includes a casing plate 1126 that has a generally flat shape. Door casing 906 includes a fourth cut-out 1128 and a fourth plurality of apertures 1130 formed through a casing plate 1126. Fourth cut-out 1128 is sized and shaped similar to second cut-out 1118 and generally aligns with second cut-out 1118 and third cut-out 1122 when door casing 906 is mounted to mounting plate 902. Door casing 906 may be mounted to door mounting face 1108 using one or more fasteners that may be inserted in the fourth plurality of apertures 1124 and the second plurality of mounting apertures 1112 through the third plurality of apertures 1124.

Door casing 906 further includes a first mounting arm 1132 and a second mounting arm 1134. First mounting arm 1132 and second mounting arm 1134 extend generally perpendicularly from casing plate 1126 above fourth cut-out 1128 when door casing 906 is mounted to refrigerator 100. A first door mounting aperture 1136 and a first motor mounting aperture 1138 are formed through first mounting arm 1132. A second door mounting aperture 1140 and a second motor mounting aperture 1142 are formed through second mounting arm 1134.

A heater strip 1144 is mounted to casing plate 1126 near an edge of fourth cut-out 1128. Thus, heater strip 1144 generally encircles fourth cut-out 1128. Heater strip 1144 is positioned to abut door gasket 1100 when ice chute door 908 is in the closed position. Ice chute door mechanism 900 is prone to condensation and frost formation. As a result, heater strip 1144 is configured to raise the temperature of casing plate 1126 and door gasket 1100 above the dew-point to insure that ice chute door 908 does not become stuck in the closed position. Heater strip 1144 may be co-molded with casing plate 1126. Placement of heater strip 1144 between casing plate 1126 and door gasket 1100 maximizes the likelihood that sufficient heat is communicated to door gasket 1100 to prevent freezing of ice chute door 908 to door casing 906 thereby rendering ice chute door 908 inoperable. Door gasket 1100 and gasket 904 on either side of heater strip 1144 limit the amount of heat flowing into the freezer compartment or the refrigerator compartment.

Door gasket 1100 may be a compression gasket that seals fourth cut-out 1128 closed when ice chute door 908 is in the closed position to provide an air tight seal and thereby keep prevent moisture and relatively warm air from migrating to the freezer compartment. Door gasket 1100 includes a gasket body 1145, a sealing edge 1146, and an attachment lip 1147. Gasket body 1145 may be generally flat with a circular shape that corresponds with the shape of fourth cut-out 1128, which in turn is shaped similarly to a periphery of chute wall 1110. Sealing edge 1146 extends around the periphery of gasket body 1145. Sealing edge 1146 further extends in a direction opposite door casing 906 to provide a sealing engagement with fourth cut-out 1128 when ice chute door 908 is in the closed position. Attachment lip 1147 extends away from gasket body 1145 in a direction similar to that of sealing edge 1146. Attachment lip 1147 surrounds a door peripheral edge 1148 of ice chute door 908 to maintain contact between ice chute door 908 and door gasket 1100 so that door gasket 1100 moves with ice chute door 908. Door gasket 1100 may be formed at least partially of an elastomeric material to provide the compression sealing between sealing edge 1146 and fourth cut-out 1128 as well as the attachment mechanism between attachment lip 1147 and door peripheral edge 1148.

Figure 11C:
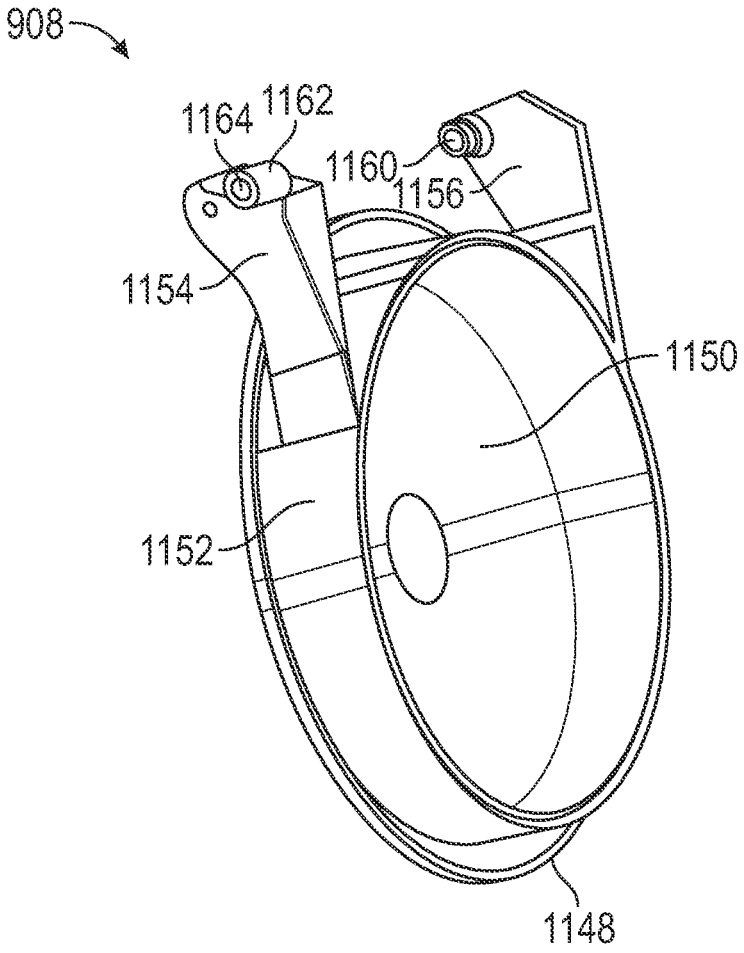
FIG. 11*c* depicts a perspective view of an ice chute door of the ice chute door mechanism of FIG. 9 in accordance with an illustrative embodiment.

With reference to FIGS. 11*a*, 11*b*, and 11*c*, ice chute door 908 includes a door plate 1150, a door peripheral wall 1152, a first door mounting arm 1154, and a second door mounting arm 1156. Door plate 1150 is generally flat and includes door peripheral edge 1148. Door plate 1150 is sized and shaped to fit within peripheral edge 1146 of door gasket 1100. Door peripheral wall 1152 extends generally perpendicularly from door plate 1150 interior of door peripheral edge 1148 and peripheral edge 1146 of door gasket 1100 when ice chute door 908 is mounted to door gasket 1100. Door peripheral wall 1152 further extends in a direction opposite a mounting side of door plate 1150 adjacent to door gasket 1100.

First door mounting arm 1154 and second door mounting arm 1156 extend upward and away from the external surface of door peripheral wall 1152 and toward first mounting arm 1132 and second mounting arm 1134, respectively. A first door mounting peg 1158 extends generally perpendicularly from a top of first door mounting arm 1154. A second door mounting peg 1160 extends generally perpendicularly from a top of second door mounting arm 1156. To mount ice chute door 908 to door casing 906, first door mounting peg 1158 is inserted into first door mounting aperture 1136, and second door mounting peg 1160 is inserted into second door mounting aperture 1140. Ice chute door 908 opens under control of motor 914 relative to door casing 906. As a result, first door mounting peg 1158 and second door mounting peg 1160 are sized to allow rotation within first door mounting aperture 1136 and second door mounting aperture 1140, respectively, while maintaining the connection between ice chute door 908 and door casing 906.

A first door linking peg 1162 extends generally perpendicularly from a top of first door mounting arm 1154 on a side of first door mounting arm 1154 generally opposite first door mounting peg 1158. First door linking peg 1162 is generally circular in shape and includes a first arm aperture 1164 that extends at least partially through a center of first door linking peg 1162. First door mounting arm 1154 further includes a second arm aperture 1200 (shown with reference to FIGS. 12*a*, 12*b*, and 12*c*) that extends at least partially through a surface of first mounting arm 1132.

Door insulator 910 is mounted to ice chute door 908 adjacent door plate 1150 and on a side of ice chute door 908 opposite door gasket 1100. Door insulator 910 is sized and shaped to fit within an interior of door peripheral wall 1152. Door insulator 910 provides additional insulation to prevent condensation and/or frost formation on ice chute door 908.

Figure 11F:
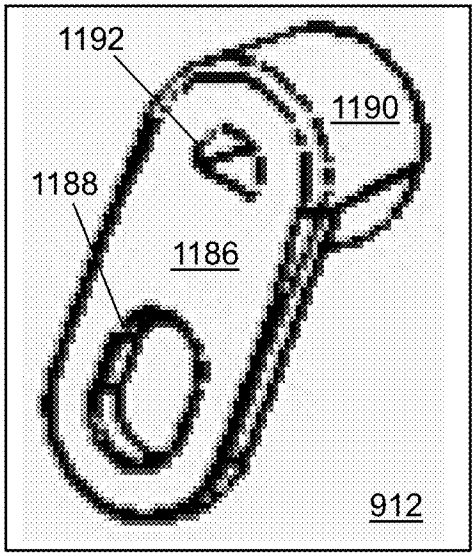
FIG. 11*f* depicts a perspective view of a link arm of the ice chute door mechanism of FIG. 9 in accordance with an illustrative embodiment.
Figure 11D:
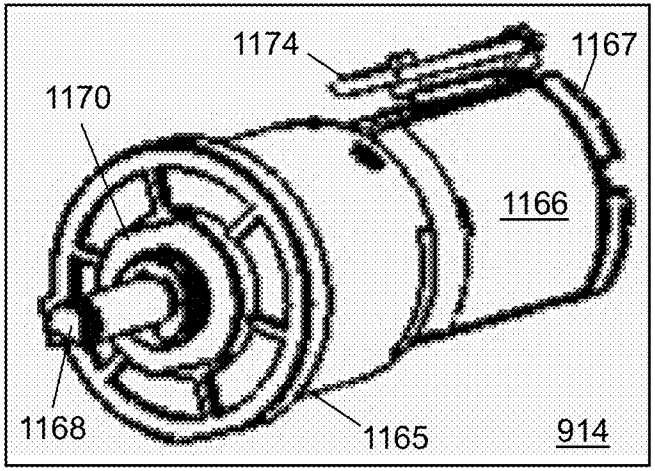
FIG. 11*d* depicts a perspective view of a motor of the ice chute door mechanism of FIG. 9 in accordance with an illustrative embodiment.

With reference to FIGS. 11*a*, 11*b*, and 11*d*, motor 914 is configured to open ice chute door 908 relative to door casing 906. Motor 914 includes a motor housing 1166, a motor shaft 1168, a first motor mounting ring 1170, a second motor mounting ring 1172, and electrical connectors 1174. Though other types of motors may be used, in an illustrative embodiment, motor 914 is a DC gearmotor. Motor shaft 1168, first motor mounting ring 1170, second motor mounting ring 1172, and the electrical connectors 1174 mount to motor housing 1166. Motor shaft 1168 extends from a first end 1165 of motor housing 1166 and is rotated under control of signals received through the electrical connectors 1174. First motor mounting ring 1170 encircles a first end of motor shaft 1168 positioned adjacent first end 1165 of motor housing 1166. Thus, first motor mounting ring 1170 has a larger dimension that motor shaft 1168. Second motor mounting ring 1172 extends from a second end 1167 of motor housing 1166 opposite first end 1165 motor housing 1166. First motor mounting ring 1170 and second motor mounting ring 1172 are generally circular in shape though other shapes may be used. To mount motor 914 to door casing 906, first motor mounting ring 1170 is inserted into first motor mounting aperture 1138, and second motor mounting ring 1172 is inserted into second motor mounting aperture 1142. Motor 914 is fixedly mounted to door casing 906. Thus, first motor mounting aperture 1138 and second motor mounting aperture 1142 are sized and shaped to fixedly hold first motor mounting ring 1170 and second motor mounting ring 1172, respectively, in position relative to door casing 906.

Figure 11E:
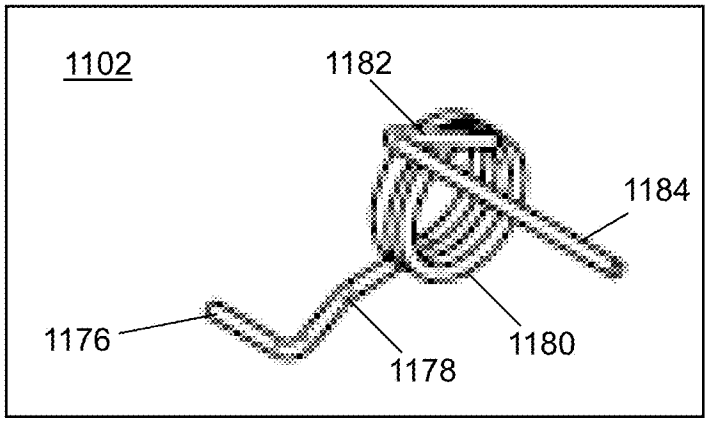
FIG. 11*e* depicts a perspective view of a biasing mechanism of the ice chute door mechanism of FIG. 9 in accordance with an illustrative embodiment.

With reference to FIGS. 11*a*, 11*b*, and 11*e*, biasing mechanism 1102 includes a first arm 1176, a first extension arm 1178, a coil 1180, a second extension arm 1182, and a second arm 1184. In an illustrative embodiment, biasing mechanism 1102 is a torsion spring. Biasing mechanism 1102 is mounted between door casing 906 and ice chute door 908 to exert a torque on ice chute door 908 to maintain ice chute door 908 in the closed position and to return ice chute door 908 to the closed position when motor 914 is de-energized. First arm 1176 extends generally perpendicularly from first extension arm 1178, which extends from coil 1180 at a first end. Second arm 1184 extends generally perpendicularly from second extension arm 1182, which extends from coil 1180 at a second end opposite the first end.

To mount biasing mechanism 1102 to ice chute door 908, first arm 1176 of biasing mechanism 1102 is inserted into first arm aperture 1164 of first door linking peg 1162, and second arm 1184 of biasing mechanism 1102 is inserted into second arm aperture 1163 of first door mounting arm 1154.

With reference to FIGS. 11*a*, 11*b*, and 11*f*, link arm 912 includes a body 1186, a translation aperture 1188, a shaft mounting peg 1190, and a shaft aperture 1192. Translation aperture 1188 is formed through a surface of body 1186 and has a generally elliptical shape. Shaft mounting peg 1190 extends from an end of body 1186 opposite translation aperture 1188. Shaft aperture 1192 extends at least partially through a surface of shaft mounting peg 1190. Shaft aperture 1192 is sized and shaped to accept motor shaft 1168. To mount ice chute door 908 to link arm 912, first door linking peg 1162 is inserted into translation aperture 1188. To mount motor 914 to link arm 912, motor shaft 1168 is inserted into shaft aperture 1192. Motor shaft 1168 is fixedly mounted to shaft aperture 1192 so that rotation of motor shaft 1168 causes corresponding translation of link arm 912. Thus, shaft aperture 1192 is sized and shaped to fixedly hold motor shaft 1168. To mount ice chute door 908 to link arm 912, first door linking peg 1162 is inserted into translation aperture 1188.

Figure 12A:
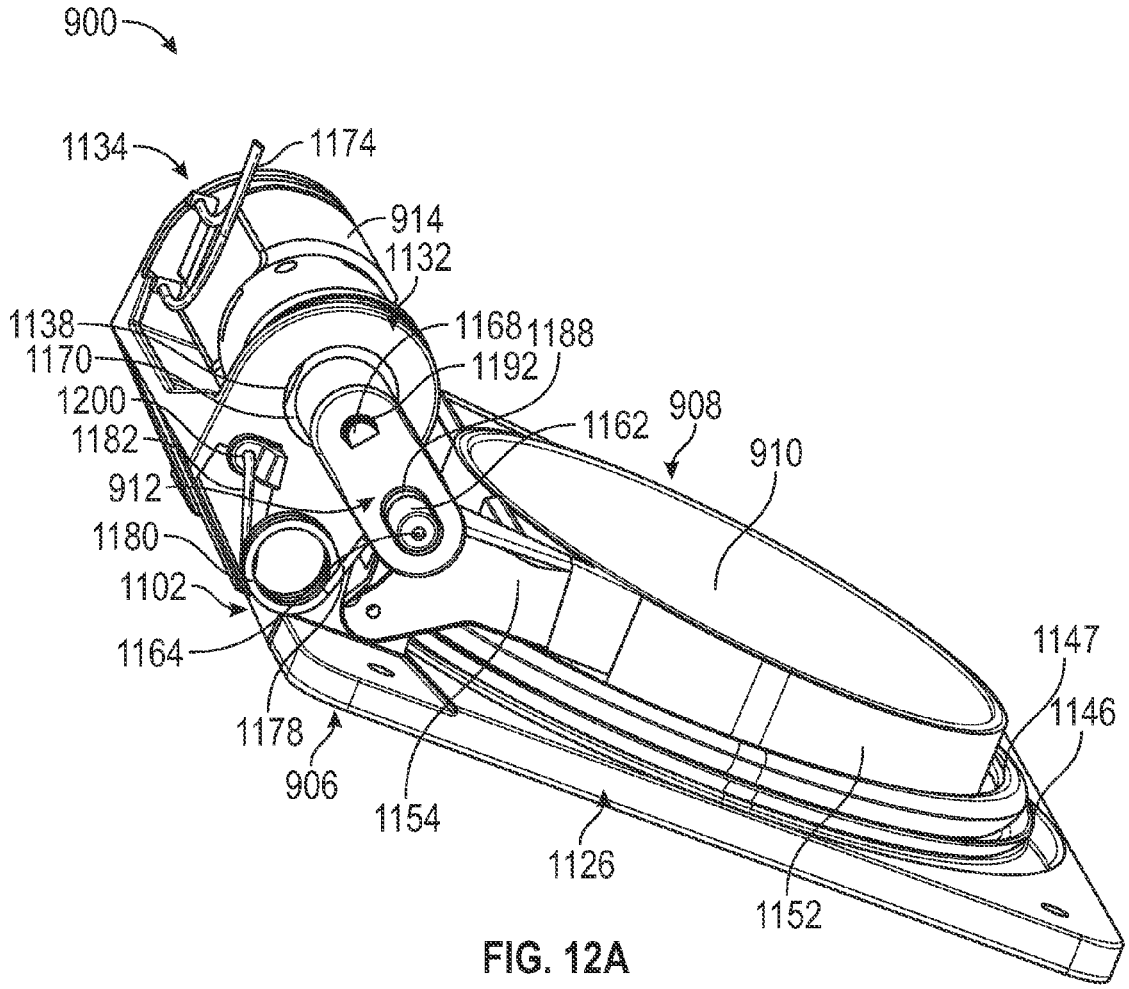
FIG. 12*a* depicts a left perspective view of an ice chute door system of the ice chute door mechanism of FIG. 9 in a closed position in accordance with an illustrative embodiment.
Figure 12B:
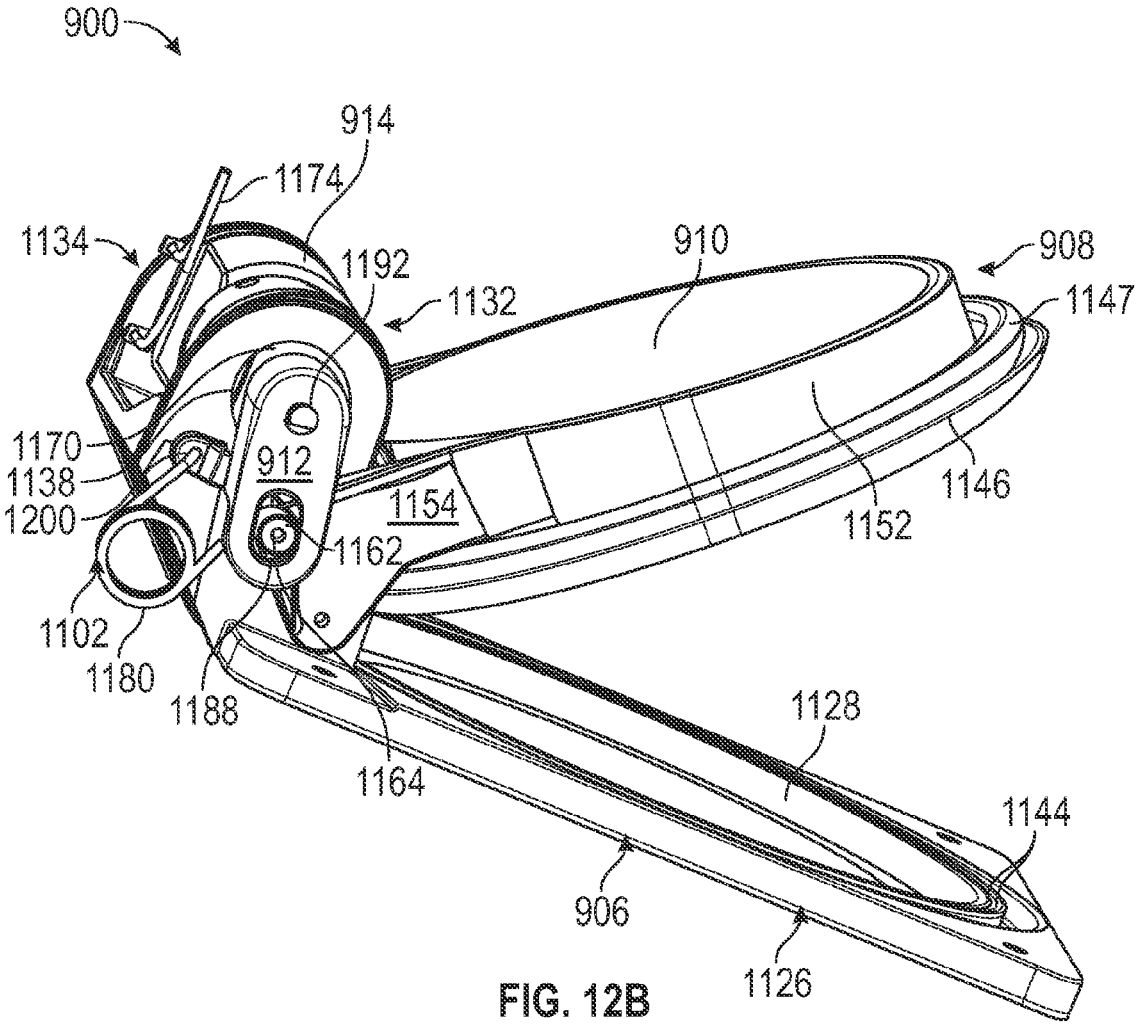
FIG. 12*b* depicts a left perspective view of the ice chute door system of the ice chute door mechanism of FIG. 9 in an open position in accordance with an illustrative embodiment.
Figure 12C:
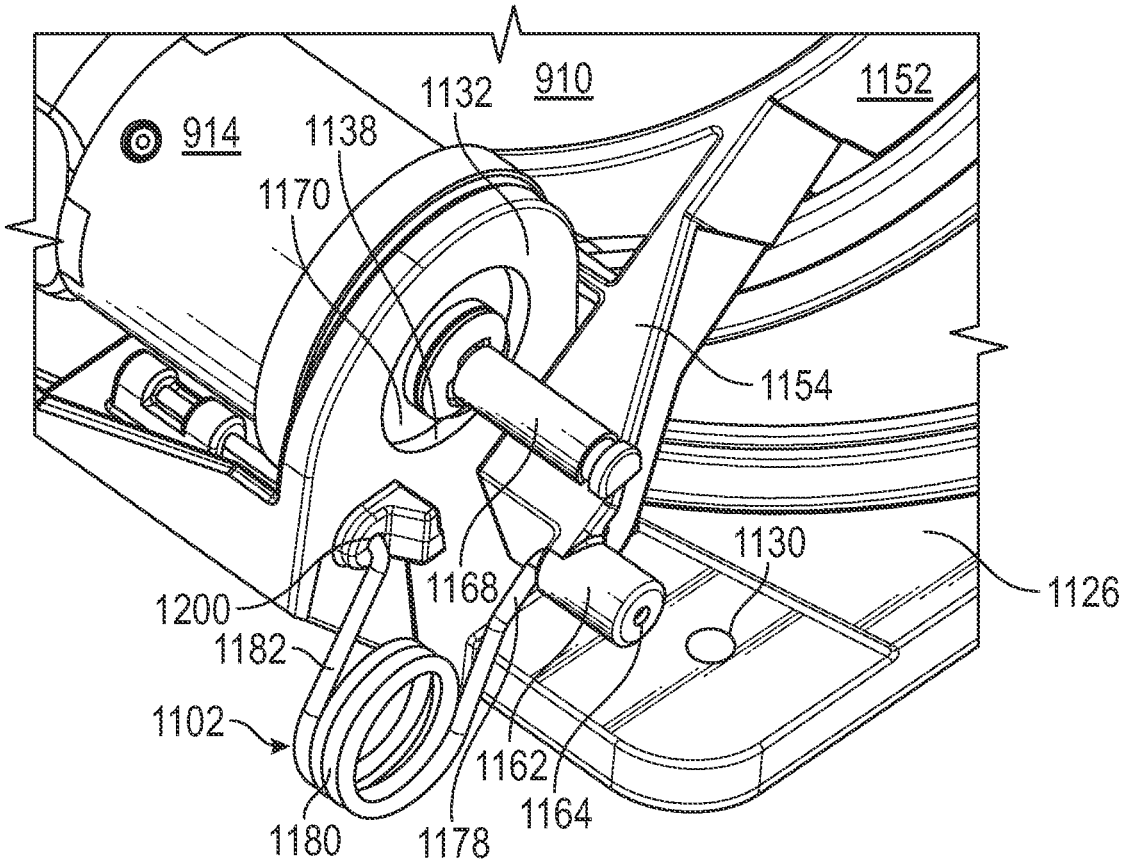
FIG. 12*c* depicts a zoomed left perspective view of an ice chute door closing mechanism of the ice chute door system of FIG. 12*b* in the open position in accordance with an illustrative embodiment.

With reference to FIGS. 12*a* and 12*b*, movement of ice chute door system 900 between a closed position as shown in FIG. 12*a* and an open position as shown in FIG. 12*b* is provided. In FIG. 12*c*, link arm 912 has been removed to show the relative positions of the components of door casing 906 and ice chute door 908. Rotation of motor shaft 1168 causes translation aperture 1188 to move along an arc-shaped path, which thereby causes corresponding movement of first door linking peg 1162. The movement of first door linking peg 1162 causes ice chute door 908 to open.

Biasing mechanism 1102 is sized and shaped such that a center of coil 1180 also translates along an arc-shaped path as ice chute door is opened. Biasing mechanism 1102 is configured to exert a maximum torque when ice chute door 908 is in the closed position and to exert a minimum torque when ice chute door 908 is in a fully open position. Thus, motor 914 opens ice chute door 908 through rotation of motor shaft 1168 by overcoming the torque exerted by biasing mechanism 1102. Ice chute door 908 closes when motor 914 is de-energized as a result of the torque exerted by biasing mechanism 1102 when ice chute door 908 is in a fully open position. Thus, as understood by a person of skill in the art, the characteristics of biasing mechanism 1102 and of motor 914 are determined based on the amount of torque needed to separate door gasket 1100 from door casing 906 and the amount of torque needed to hold ice chute door 908 in the open position.

Figure 13:
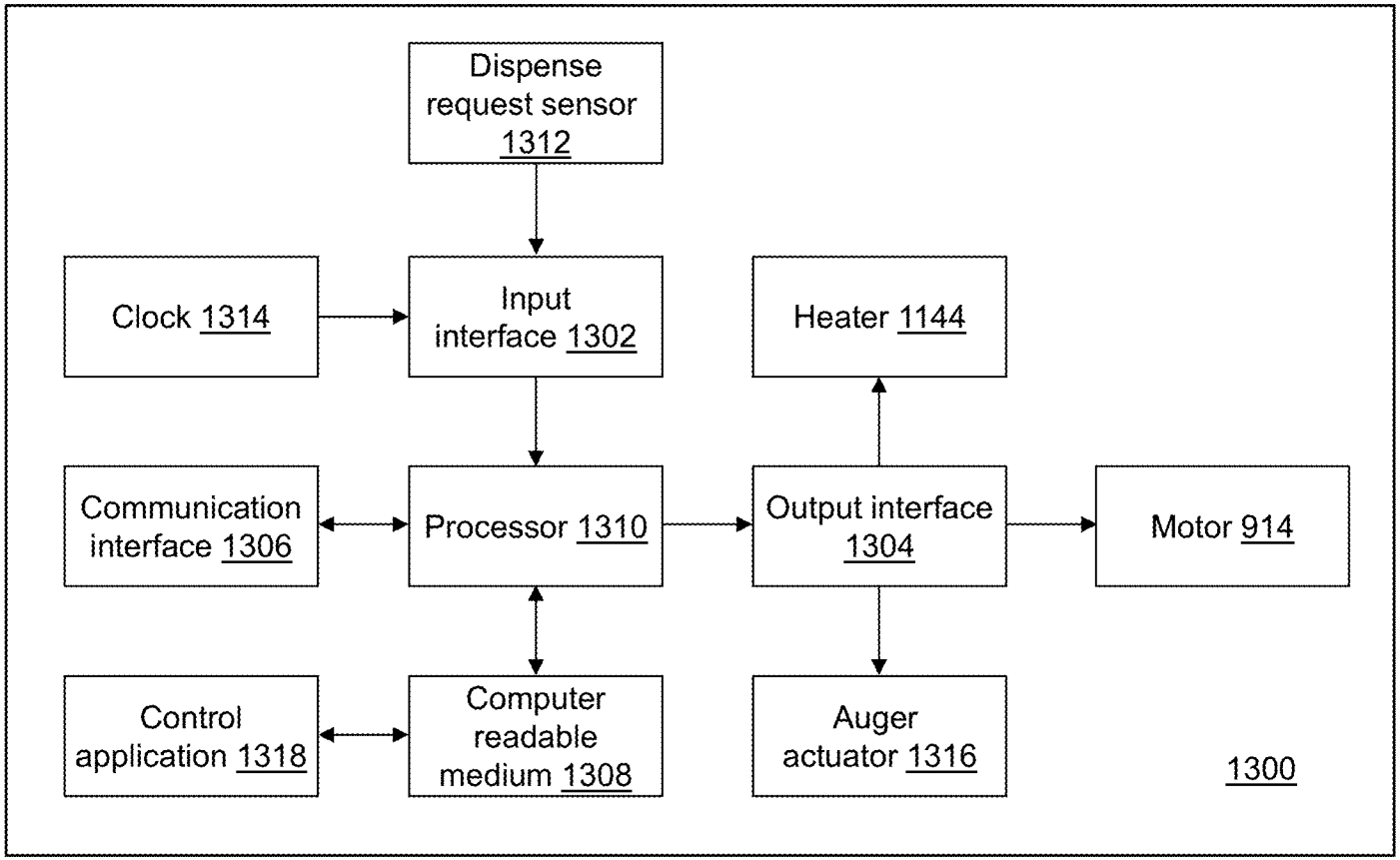
FIG. 13 depicts a block diagram of an ice dispensing control system in accordance with an illustrative embodiment.

With reference to FIG. 13, a block diagram of an ice dispensing control system 1300 is shown in accordance with an illustrative embodiment. Ice dispensing control system 1300 may include an input interface 1302, an output interface 1304, a communication interface 1306, a computer-readable medium 1308, a processor 1310, ice dispense request sensor 1312, a clock 1314, heater strip 1144, motor 914, auger actuator 1316, and a control application 1318. Different and additional components may be incorporated into ice dispensing control system 1300 depending on the embodiment.

Input interface 1302 provides an interface for receiving information from components of ice dispensing control system 1300 for processing by processor 1310. For example, input interface 1302 may include electrical connectors that connect ice dispense request sensor 1312 and clock 1314 with processor 1310. The same interface may support both input interface 1302 and output interface 1304.

Output interface 1304 provides an interface for outputting information from processor 1310 to components of ice dispensing control system 1300 to control their operation. For example, output interface 1304 may include electrical connectors that connect heater strip 1144, motor 914, and auger actuator 1316 with processor 1310.

Communication interface 1306 provides an interface for receiving and transmitting data between devices using various protocols, transmission technologies, and media as known to those skilled in the art. Communication interface 1306 may support communication using various transmission media that may be wired or wireless. Ice dispensing control system 1300 may have one or more communication interfaces that use the same or a different communication interface technology. Data and messages may be transferred between processor 1310 and other components of refrigerator 100 using communication interface 1306. Thus, communication interface 1306 provides an alternative interface to input interface 1302 and output interface 1304.

Computer-readable medium 1308 is an electronic holding place or storage for information so that the information can be accessed by processor 1310 as known to those skilled in the art. Computer-readable medium 1308 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., CD, DVD, . . . ), smart cards, flash memory devices, etc. Ice dispensing control system 1300 may have one or more computer-readable media that use the same or a different memory media technology. Ice dispensing control system 1300 also may have one or more drives that support the loading of a memory media such as a CD or DVD.

Processor 1310 executes instructions as known to those skilled in the art. The instructions may be carried out by a special purpose computer, logic circuits, or hardware circuits. Thus, processor 1310 may be implemented in hardware, firmware, or any combination of these methods and/or in combination with software. The term "execution" is the process of running an application or the carrying out of the operation called for by an instruction. The instructions may be written using one or more programming language, scripting language, assembly language, etc. Processor 1310 executes an instruction, meaning that it performs/controls the operations called for by that instruction. Processor 1310 operably couples with output interface 1304, with input interface 1302, with computer-readable medium 1308, and with communication interface 1306 to receive, to send, and to process information. Processor 1310 may retrieve a set of instructions from a permanent memory device and copy the instructions in an executable form to a temporary memory device that is generally some form of RAM. Ice dispensing control system 1300 may include a plurality of processors that use the same or a different processing technology.

Control application 1318 performs operations associated with controlling the operation of ice maker/dispenser 126 including ice chute door mechanism 900. Some or all of the operations described herein may be embodied in control application 1318. The operations may be implemented using hardware, firmware, software, or any combination of these methods. With reference to the example embodiment of FIG. 13, control application 1318 is implemented in software (comprised of computer-readable and/or computer-executable instructions) stored in computer-readable medium 1308 and accessible by processor 1310 for execution of the instructions that embody the operations of control application 1318. Control application 1318 may be written using one or more programming languages, assembly languages, scripting languages, etc.

Figure 14:
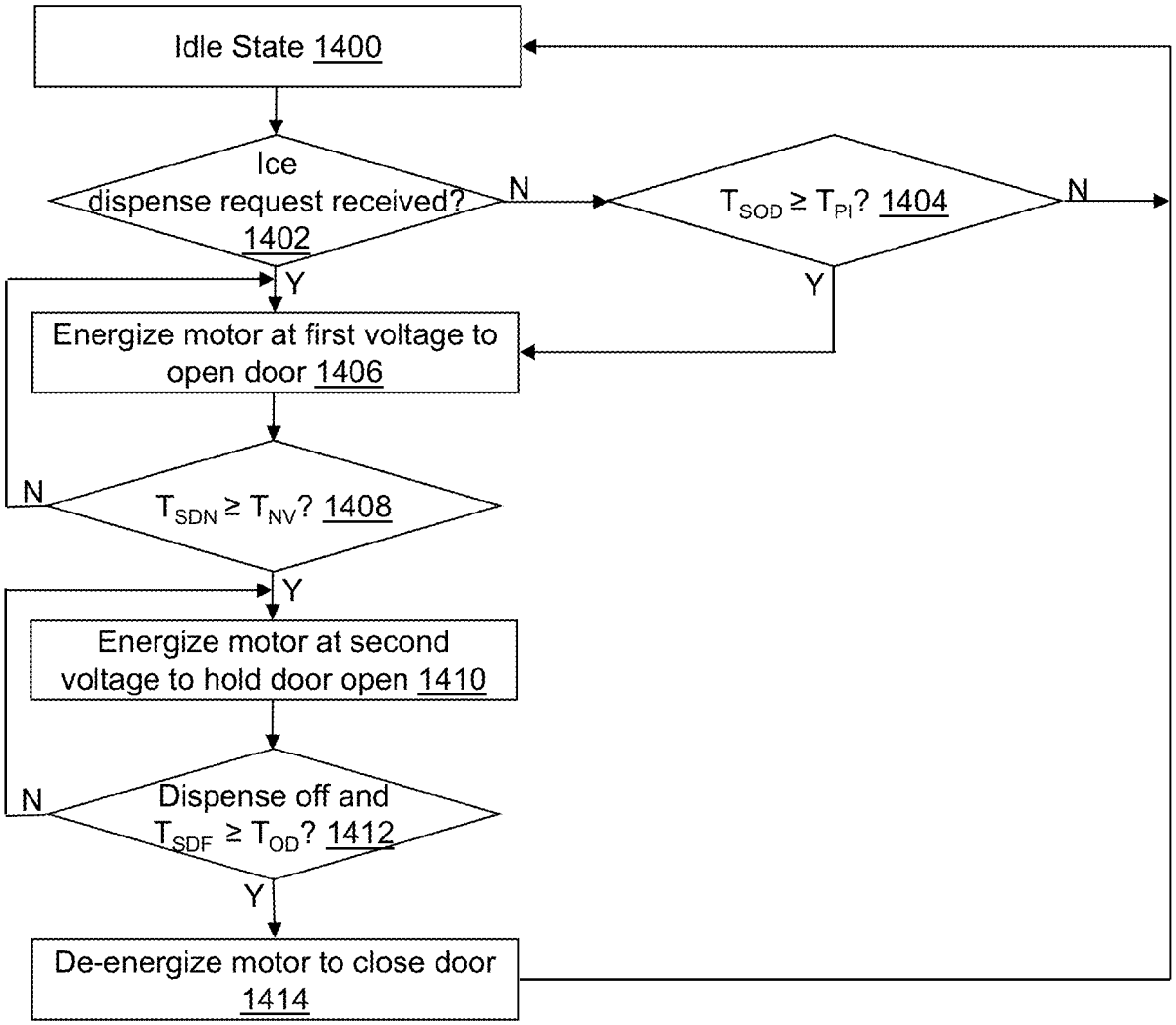
FIG. 14 depicts a flow diagram illustrating example operations performed through use of a control application of the ice dispensing control system of FIG. 13 in accordance with an illustrative embodiment.

With reference to FIG. 14, example operations associated with control application 1318 are described. Additional, fewer, or different operations may be performed depending on the embodiment. For example, control application 1318 may provide additional functionality not described such as controlling the making of ice, controlling light in refrigerator 100, diagnostics, etc. The order of presentation of the operations of FIG. 14 is not intended to be limiting. Thus, although some of the operational flows are presented in sequence, the various operations may be performed in various repetitions, concurrently, and/or in other orders than those that are illustrated.

In an operation 1400, ice chute door mechanism 900 is an idle state. For example, refrigerator 100 and ice maker/dispenser 126 are powered on. Motor 914 is de-energized or in the "off" state. Ice chute door 908 is in the closed position with a maximum torque exerted by biasing mechanism 1102 to seal chute 718 including chute wall 1110 from the refrigerator compartment or the exterior of refrigerator 100 if ice chute door mechanism 900 is mounted to freezer door 102 or refrigerator door 104. Heater strip 1144 may be on when ice chute door mechanism 900 is in the idle state.

In an operation 1402, a determination is made concerning whether or not an ice dispense request is received from ice dispense request sensor 1312. The determination may be triggered automatically when a signal is received from ice dispense request sensor 1312 by processor 1310 as understood by a person of skill in the art. As discussed previously, various electrical, optical, electro-mechanical devices may be used to detect that a consumer is requesting the dispensation of ice into a container and to send a signal to processor 1310. When an ice dispense request is received, processing continues in operation 1406.

During time periods when the ice dispense request is not received, processing continues in an operation 1404. In operation 1404, a determination is made concerning how long it has been since ice chute door 908 was opened. If the time since ice chute door 908 was last opened, $T_{SOD}$, exceeds a threshold, $T_{PI}$, processing continues in operation 1406. Thus, if $T_{SOD} \geq T_{PI}$, processing continues in operation 1406 to open ice chute door 908 to release any ice not previously released from chute 718 and chute wall 1110. Periodic opening of ice chute door 908 prevents ice from being trapped in mounting plate 902 for a long period of time causing potential blockage of chute 718 and/or chute wall 1110. In an illustrative embodiment, threshold, $T_{PI}$ is set to 24 hours. Of course, shorter or longer time periods may be used in alternative embodiments.

Figure 15:
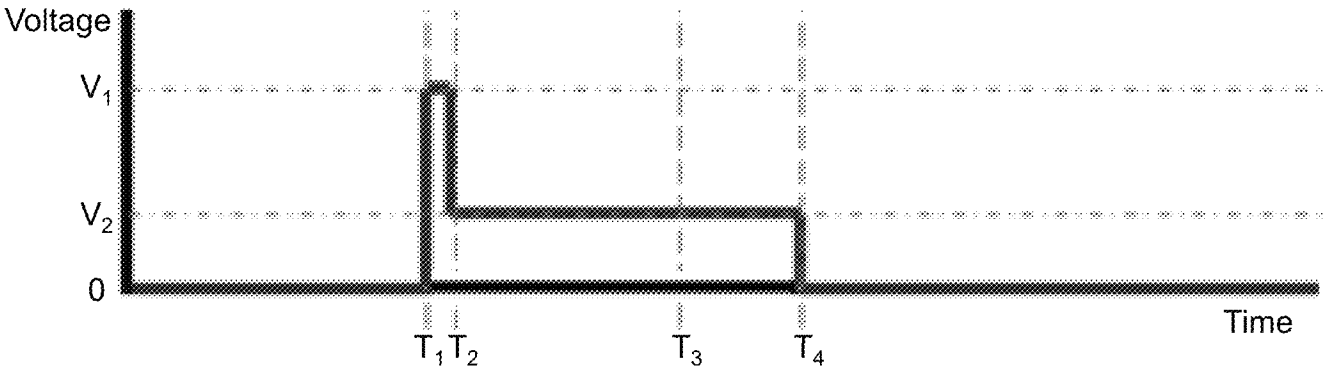
FIG. 15 depicts a motor voltage diagram that results through use of the control application of the ice dispensing control system of FIG. 13 in accordance with an illustrative embodiment.

In operation 1406, motor 914 is energized at a first voltage $V_1$ as shown with reference to FIG. 15 and auger actuator 1316 is activated to rotate the auger in ice receptacle 700 to dispense ice through ice dispensing aperture 716. In an operation 1408, a determination is made concerning how long it has been since motor 914 was energized. If the time since motor 914 was energized, $T_{SDN}$, exceeds a threshold, $T_{NV}$, processing continues in an operation 1410. If the time since motor 914 was energized, $T_{SDN}$, does not exceed a threshold, $T_{NV}$, processing continues in operation 1408 to wait the defined time period to make sure ice chute door 908 is fully opened by motor 914. In an illustrative embodiment, threshold, $T_{NV}$ is set to 3 seconds. Of course, shorter or longer time periods may be used in alternative embodiments.

In operation 1410, motor 914 is energized at a second voltage $V_2$. As shown with reference to FIG. 15, second voltage $V_2$ is smaller than first voltage $V_1$, and threshold $T_{NV}$ is $T_2-T_1$. Second voltage $V_2$ may be selected as the voltage which operates motor 914 in a stall state to hold ice chute door 908 open, thus overcoming the torque exerted by biasing mechanism 1102 and the weight of ice chute door 908, door gasket 1100, and insulator 910. Operating motor 914 at a second voltage $V_2$ avoids overheating of motor 914 if a long ice dispense request is received and reduces the amount of energy expended in operating ice chute door mechanism 900. In an illustrative embodiment, $V_1$ is 12 volts and $V_2$ is 3 volts. Of course, other voltage levels may be used dependent on motor 914, biasing mechanism 1102, ice chute door 908, etc.

In an operation 1412, a determination is made concerning whether or not an ice dispense request is no longer received from ice dispense request sensor 1312. The determination may be triggered automatically when a signal is no longer received from ice dispense request sensor 1312 by processor 1310 as understood by a person of skill in the art. If the ice dispense request is no longer received, auger actuator 1316 is no longer activated to rotate auger in ice receptacle 700 and a determination is made concerning whether or not a time period since the request was no longer received has expired. If the time since the ice dispense request was received, $T_{SDF}$, exceeds a threshold, $T_{OD}$, processing continues in an operation 1414. If the time since the ice dispense request was no longer received has not expired, i.e., $T_{SDF}$, does not exceed the threshold, $T_{OD}$, processing continues in operation 1410 to continue to energize motor 914 at second voltage $V_2$ to hold ice chute door 908 open to allow any remaining ice dispensed onto chute 718 and chute wall 1110 to fall through fourth cut-out 1128. In an illustrative embodiment, threshold, $T_{OD}$ is set to 6 seconds. Of course, shorter or longer time periods may be used in alternative embodiments. As shown with reference to FIG. 15, threshold $T_{OD}$ is $T_4-T_3$, where $T_3$ is the time at which the consumer stopped requesting the dispensation of ice.

In operation 1414, motor 914 is de-energized, which closes ice chute door 908 through operation of the torque generated by biasing mechanism 1102 which overcomes the internal resistance of de-energized motor 914. Processing continues at operation 1400 to return ice chute door mechanism 900 to the idle state and await another ice dispense request or expiration of the time period defined by threshold, $T_{PI}$.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A non-transitory computer-readable medium having stored thereon computer-readable instructions that when executed by a processor cause the processor to:

control opening of an ice chute door by energizing a motor at a first voltage for a first time period after receipt of an ice dispense request to fully open the ice chute door;

after energizing the motor at the first voltage for the first time period, control energizing of the motor at a second voltage to maintain the ice chute door in the fully open position, wherein the second voltage is less than the first voltage;

after energizing the motor at the second voltage, control de-energizing of the motor to allow the ice chute door to return to a closed position, wherein the motor is de-energized after expiration of a second time period measured after the ice dispense request is no longer received;

after de-energizing the motor, control opening of the ice chute door by again energizing the motor at the first voltage for the first time period after expiration of a third time period measured since the ice chute door returned to the closed position;

after again energizing the motor at the first voltage for the first time period, control energizing of the motor at the second voltage for the second time period to maintain the ice chute door in the fully open position; and after energizing the motor at the second voltage for the second time period, control de-energizing of the motor to allow the ice chute door to again return to the closed position.

2. The non-transitory computer-readable medium of claim 1, wherein the motor is de-energized by turning the motor off.

3. The non-transitory computer-readable medium of claim 1, wherein the second voltage is selected to operate the motor in a stall state.

4. The non-transitory computer-readable medium of claim 1, wherein the second voltage is less than or equal to 25% of the first voltage.

5. An ice dispensing system comprising:

a door casing;

an ice chute door mounted to the door casing;

a motor mounted to the ice chute door and configured to move the ice chute door to a fully open position relative to the door casing when energized;

a processor; and a computer-readable medium operably coupled to the processor, the computer-readable medium having computer-readable instructions stored thereon that, when executed by the processor, cause the processor to control opening of the ice chute door by energizing the motor at a first voltage for a first time period after receipt of an ice dispense request to open the ice chute door to the fully open position;

after energizing the motor at the first voltage for the first time period, control energizing of the motor at a second voltage to maintain the ice chute door in the fully open position, wherein the second voltage is less than the first voltage;

after energizing the motor at the second voltage, control de-energizing of the motor to allow the ice chute door to return to a closed position, wherein the motor is de-energized after expiration of a second time period measured after the ice dispense request is no longer received;

after de-energizing the motor, control opening of the ice chute door by again energizing the motor at the first voltage for the first time period after expiration of a third time period measured since the ice chute door returned to the closed position;

after again energizing the motor at the first voltage for the first time period, control energizing of the motor at the second voltage for the second time period to maintain the ice chute door in the fully open position; and after energizing the motor at the second voltage for the second time period, control de-energizing of the motor to allow the ice chute door to again return to the closed position.

6. The ice dispensing system of claim 5, wherein the second voltage is less than or equal to 25% of the first voltage.

7. The ice dispensing system of claim 5, wherein the second voltage is selected to operate the motor in a stall state.

8. The ice dispensing system of claim 5, further comprising a dispense request sensor operably coupled to the processor and configured to create the ice dispense request, wherein the computer-readable instructions further cause the processor to detect the ice dispense request.

9. The ice dispensing system of claim 5, further comprising:

an ice receptacle comprising a plurality of walls and an ice dispensing aperture formed through a wall of the plurality of walls; and an ice chute configured to mount between the ice dispensing aperture and the ice chute door and to receive ice from the ice dispensing aperture.

10. The ice dispensing system of claim 9, further comprising a mounting plate, wherein at least a portion of the ice chute is mounted to the mounting plate, and further wherein the mounting plate is configured to mount the ice chute to a refrigerator wall.

11. The ice dispensing system of claim 10, further comprising a gasket mounted between the door casing and the mounting plate.

12. The ice dispensing system of claim 5, further comprising:

a heater strip mounted in the door casing to abut the ice chute door when the ice chute door is in the closed position;

wherein the computer-readable instructions further cause the processor to control operation of the heater strip.

13. The ice dispensing system of claim 12, further comprising a door gasket mounted to the ice chute door and positioned between the heater strip and the ice chute door when the ice chute door is in the closed position.

14. The ice dispensing system of claim 13, further comprising a door insulator mounted to the ice chute door and positioned on a side of the ice chute door opposite the door gasket.

15. The ice dispensing system of claim 5, further comprising:

a link arm linking a shaft of the motor to the ice chute door; and a biasing mechanism, wherein the biasing mechanism is mounted between the door casing and the ice chute door to exert a torque on the ice chute door to maintain the ice chute door in the closed position and to return the ice chute door to the closed position.

16. The ice dispensing system of claim 15, wherein the biasing mechanism comprises a spring comprising a first arm, a second arm, and a coil between the first arm and the second arm, the first arm is mounted to the ice chute door, the second arm is mounted to the door casing, and a longitudinal center of the coil is mounted to the link arm such that the center translates as the ice chute door opens to maximize the torque when the ice chute door is in the closed position and to minimize the torque when the ice chute door is in a fully open position.

17. A device comprising:

a plurality of walls defining a freezer compartment;

a door;

a hinge pivotally mounting the door to a wall of the plurality of walls;

an ice chute door casing mounted to one of the plurality of walls or the door;

an ice chute door mounted to the ice chute door casing;

a motor mounted to the ice chute door to move the ice chute door to a fully open position relative to the ice chute door casing when energized;

a processor; and a computer-readable medium operably coupled to the processor, the computer-readable medium having computer-readable instructions stored thereon that, when executed by the processor, cause the processor to control opening of the ice chute door by energizing the motor at a first voltage for a first time period after receipt of an ice dispense request to open the ice chute door to the fully open position;

after energizing the motor at the first voltage for the first time period, control energizing of the motor at a second voltage to maintain the ice chute door in the fully open position, wherein the second voltage is less than the first voltage;

after energizing the motor at the second voltage, control de-energizing of the motor to allow the ice chute door to return to a closed position, wherein the motor is de-energized after expiration of a second time period measured after the ice dispense request is no longer received;

after de-energizing the motor, control opening of the ice chute door by again energizing the motor at the first voltage for the first time period after expiration of a third time period measured since the ice chute door returned to the closed position;

after again energizing the motor at the first voltage for the first time period, control energizing of the motor at the second voltage for the second time period to maintain the ice chute door in the fully open position; and after energizing the motor at the second voltage for the second time period, control de-energizing of the motor to allow the ice chute door to again return to the closed position.

18. The device of claim 17, further comprising:

an ice receptacle comprising a second plurality of walls and an ice dispensing aperture formed through a wall of the second plurality of walls;

an ice chute configured to mount between the ice dispensing aperture and the ice chute door and to receive ice through the ice dispensing aperture;

a mounting plate, wherein at least a portion of the ice chute is mounted to the mounting plate, and further wherein the mounting plate is configured to mount the ice chute to the one of the plurality of walls or the door; and a gasket mounted between the ice chute door casing and the mounting plate.

19. The device of claim 17, wherein the second voltage is selected to operate the motor in a stall state.

20. The device of claim 17, further comprising:

a link arm linking a shaft of the motor to the ice chute door; and a biasing mechanism, wherein the biasing mechanism is mounted between the ice chute door casing and the ice chute door to exert a torque on the ice chute door to maintain the ice chute door in the closed position and to return the ice chute door to the closed position, wherein the biasing mechanism comprises a spring comprising a first arm, a second arm, and a coil between the first arm and the second arm, the first arm is mounted to the ice chute door, the second arm is mounted to the ice chute door casing, and a longitudinal center of the coil is mounted to the link arm such that the longitudinal center translates as the ice chute door opens to maximize the torque when the ice chute door is in the closed position and to minimize the torque when the ice chute door is in a fully open position.

* * * * *

UNITED STATES PATENT AND TRADEMARK OFFICE

CERTIFICATE OF CORRECTION

PATENT NO. : 9,291,382 B2
APPLICATION NO. : 13/744568
DATED : March 22, 2016
INVENTOR(S) : Hardesty et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 557 days.

Signed and Sealed this
Twenty-sixth Day of July, 2016

Michelle K. Lee

Michelle K. Lee
*Director of the United States Patent and Trademark Office*